US005430664A

United States Patent [19]

Cargill et al.

[11] Patent Number: 5,430,664

[45] Date of Patent: Jul. 4, 1995

[54] DOCUMENT COUNTING AND BATCHING APPARATUS WITH COUNTERFEIT DETECTION

[75] Inventors: N. Allen Cargill, Warminster; George P. McInerny, Langhorne; Arthur D. Hughes, Gladwyne, all of Pa.

[73] Assignee: Technitrol, Inc., Feasterville, Pa.

[21] Appl. No.: 22,145

[22] Filed: Feb. 25, 1993

Related U.S. Application Data

[63] Continuation-in-part of Ser. No. 913,224, Jul. 14, 1992, abandoned.

[51] Int. Cl.[6] ..... G07D 7/00

[52] U.S. Cl. ..... 364/550; 194/207; 194/213; 364/464.01; 377/8; 382/135

[58] Field of Search ..... 194/206, 207, 213; 364/464.01, 550; 377/8; 382/7

[56] References Cited

U.S. PATENT DOCUMENTS

| | | | |
|---|---|---|---|
| Re. 29,470 | 11/1977 | Jones | 235/925 B |
| Re. 33,847 | 3/1992 | DeBlasio | 271/3 |
| 2,731,621 | 1/1956 | Sontheimer | 340/149 |
| 2,827,167 | 3/1958 | Joseph et al. | 209/111 |
| 3,771,783 | 11/1973 | McInerny | 271/125 |
| 3,857,559 | 12/1974 | McInerny | 271/122 |
| 3,870,868 | 3/1975 | Jones | 235/925 B |
| 3,912,255 | 10/1975 | McInerny | 271/80 |
| 3,982,107 | 9/1976 | Butler | 235/92 DN |
| 4,015,110 | 3/1977 | Jones | 235/925 B |
| 4,099,214 | 7/1978 | Jones | 361/31 |
| 4,114,804 | 9/1978 | Jones et al. | 235/476 |
| 4,146,218 | 3/1979 | Loftus et al. | 271/220 |
| 4,216,952 | 8/1980 | McInerny | 271/10 |
| 4,237,378 | 12/1980 | Jones | 250/223 R |
| 4,275,874 | 6/1981 | DeBlasio | 271/4 |
| 4,283,708 | 8/1981 | Lee | 382/7 |
| 4,313,598 | 2/1982 | DeBlasio | 271/124 |
| 4,326,636 | 4/1982 | Kawakami | 209/534 |
| 4,381,447 | 4/1983 | Horvath et al. | 250/223 R |
| 4,384,194 | 5/1983 | Jones | 377/8 |

(List continued on next page.)

FOREIGN PATENT DOCUMENTS

| | | |
|---|---|---|
| 0115208 | 8/1984 | European Pat. Off. . |
| 0204574 | 12/1986 | European Pat. Off. . |
| 0206675 | 12/1986 | European Pat. Off. . |
| 0260940 | 3/1988 | European Pat. Off. . |
| 0276814 | 8/1988 | European Pat. Off. . |
| 0286378 | 10/1988 | European Pat. Off. . |
| 066306 | 5/1990 | European Pat. Off. . |
| 0434232 | 6/1991 | European Pat. Off. . |
| 0451882 | 10/1991 | European Pat. Off. . |
| 0477711 | 4/1992 | European Pat. Off. . |
| WO91/10902 | 7/1991 | WIPO . |

OTHER PUBLICATIONS

"Magnetic Couterfeit Detection Device Service Manual," Advanced Technics and Systems, S. A. (21 sheets).

*Primary Examiner*—Edward R. Cosimano

*Attorney, Agent, or Firm*—Dann, Dorfman, Herrell and Skillman

[57] ABSTRACT

An apparatus for counting and verifying documents is provided with a digital control network. The digital control network coordinates the operations of counting and verifying documents. A transport mechanism moves documents along a guide path through the apparatus. Sensors are located along the guide path for determining optical and magnetic characteristics of the documents and producing signals relative thereto. The measured signals are sampled and digitized by an analog-to-digital converter under the control of a microprocessor. Multiple samples of the sensor signals are accumulated within memory as each document passes adjacent to the sensors. The accumulated values are compared with reference values in order to verify each document which passes adjacent to the sensors. Documents are counted after verification. Individual piece counts and monetary values of such piece counts are provided and counterfeit documents, such as passed for United States currency, can be detected.

10 Claims, 14 Drawing Sheets

U.S. PATENT DOCUMENTS

| | | | |
|---|---|---|---|
| 4,406,996 | 9/1983 | Oka | 340/674 |
| 4,416,449 | 11/1983 | McInerny | 271/122 |
| 4,420,153 | 12/1983 | Winkler et al. | 271/304 |
| 4,443,006 | 4/1984 | Hasegawa | 271/10 |
| 4,500,002 | 2/1985 | Koshio et al. | 209/534 |
| 4,500,084 | 2/1985 | McInerny | 271/35 |
| 4,504,916 | 3/1985 | Oka | 364/562 X |
| 4,593,184 | 6/1986 | Bryce et al. | 235/449 |
| 4,608,704 | 8/1986 | Sherman, III et al. | 377/8 |
| 4,615,518 | 10/1986 | DiBlasio | 271/10 |
| 4,617,458 | 10/1986 | Bryce | 235/449 |
| 4,671,502 | 6/1987 | Sherman, III et al. | 377/8 X |
| 4,671,502 | 6/1987 | Sherman, III et al. | 271/4 |
| 4,703,172 | 10/1987 | Sherman, III et al. | 250/223 R |
| 4,707,599 | 11/1987 | Sherman, III et al. | 250/223 R |
| 4,709,820 | 12/1987 | Jenkins et al. | 209/534 |
| 4,737,627 | 4/1988 | Hughes et al. | 250/223 R |
| 4,741,526 | 5/1988 | Reed | 271/261 |
| 4,749,087 | 6/1988 | Buttifant | 209/534 |
| 4,761,002 | 8/1988 | Reed et al. | 271/111 |
| 4,764,725 | 8/1988 | Bryce | 324/234 |
| 4,790,526 | 12/1988 | Egashira | 271/315 |
| 4,796,878 | 1/1989 | Nichelson et al. | 271/10 |
| 4,818,871 | 4/1989 | Dupoy et al. | 250/308 |
| 4,889,240 | 12/1989 | Sato et al. | 209/534 |
| 4,895,359 | 1/1990 | Ookawa | 271/125 |
| 4,906,842 | 3/1990 | Melcher | 250/205 |
| 4,909,149 | 3/1990 | Melcher | 101/232 |
| 4,922,110 | 5/1990 | Melcher | 250/556 |
| 4,931,779 | 6/1990 | Melcher | 340/674 |
| 4,944,505 | 7/1990 | Sherman, III | 271/265 |
| 5,005,688 | 4/1991 | Yukimoto et al. | 194/206 |
| 5,058,875 | 10/1991 | Stewart | 271/10 |
| 5,068,519 | 11/1991 | Bryce | 235/449 |
| 5,118,091 | 6/1992 | Nagamoto et al. | 271/122 |
| 5,295,196 | 3/1994 | Raterman et al. | 382/7 |
| 5,309,515 | 5/1994 | Troung et al. | 382/7 |
| 5,341,408 | 8/1994 | Melcher et al. | 377/8 |
| 5,377,805 | 1/1995 | Ono et al. | 194/206 |

DOCUMENT COUNTING AND BATCHING APPARATUS WITH COUNTERFEIT DETECTION

This application is a continuation-in-part of U.S. application Ser. No. 07/913,224 filed Jul. 14, 1992, now abandoned.

FIELD OF THE INVENTION

This invention relates to a document counting and batching apparatus which incorporates magnetic detection of counterfeit suspect documents.

BACKGROUND

In order to be successful in the marketplace, document counters, which are used to count paper money and other documents, should be capable of operating at low and high speeds, while accurately counting and batching documents, which may include currency and food coupons. Prior to processing documents in standard document counters, the documents are manually separated into stacks of like denomination or type. In developing a comprehensive document counter, it would be desirable for the document counting and batching apparatus to provide visual running totals of the pieces and value of the currency counted and/or batched, to be capable of detecting errors such as counterfeit suspects, doubles, chains, off-widths, and half documents, and the document counter should be designed to stop when an error is detected to permit the operator to correct the detected error. As an additional feature, it would be desirable for a document counting and batching apparatus to be capable of (i) stand alone operation, (ii) connection as a slave to a host, such as a personal computer, or (iii) stand alone operation with connection to a printer for a print-out of totals. It would further be desirable for a document counter to maintain and to selectively display or print several types of counts and totals divided into operator-designated categories. One category would be a piece count with no designation of denomination. Other categories (such as 1, 2, 5, 10, 20, 50, and 100 dollar denominations) would be piece counts of operator-designated denominations. It would be desirable relative to these categories to display a running piece count of the first category, and running piece counts multiplied by the denomination to yield the value of denominations counted for each of the other categories. Also, it would be desirable to be able to display, or to display and to print, the accumulated totals for each category in the same or similar format as for running total displays. Further, it would be desirable to display and/or print the grand total value of the values of all of the denomination categories counted.

Document counting and handling devices are known which count, verify and stack a particular type of document, such as U.S. currency. Among such devices are those that utilize analog comparator circuits to verify whether the optical and magnetic characteristics of a document falls within thresholds set by discrete electronic components which bias the comparator circuits. In order to adapt such devices for counting and verifying documents which vary with respect to optical or magnetic properties, it is necessary to manually adjust the biasing components of the analog comparator circuits. However, the particular combination of verification tests that may be implemented in a document counting device of the prior art, which is adapted for one type of document such as U.S. currency, may not be suitable for another type of document such as coupons, food stamps, or foreign currency. Accordingly, it would be desirable to provide a control system for a document counting apparatus in which verification tests can be selectively enabled and in which verification thresholds can easily be selected to conform to the characteristics or properties of a variety of documents.

It has been found that accurate verification of documents based on optical and magnetic properties of documents in a high-speed document counting device is complicated by the presence of electrical noise from a variety of noise sources within the counting device. In order to increase the reliability with which documents are verified as genuine, it would be desirable to provide a system for document verification which is essentially immune to the influence of such electrical noise.

SUMMARY OF THE INVENTION

A document counter for counting and batching of documents, such as paper currency and the like, is provided which employs a hopper for containing a stack of documents of a single denomination or type. A pair of pickers pick documents off of the bottom of a stack and urge the documents toward a feed roller. The feed roller frictionally engages the documents and feeds them into the apparatus. A stripper belt is rotated in opposition to the direction of rotation of the feed roller to strip the documents so that the leading edge of each document is fed one at a time toward an accelerator. The accelerator accelerates the documents along a guide path and places a gap between the documents, which are then passed on to a stacker which decelerates the documents and stacks them for removal. Sensors are provided to detect the documents and/or characteristics of the documents and to provide a signal to the controller, which accumulates and correlates the signals and then activates a display to provide a visual indication of the totals of pieces and values of denominations of counted and/or batched documents. The apparatus is also designed to indicate errors such as counterfeit suspects, doubles, chains, off-widths, and half documents, and stop operation of the apparatus to permit removal of any detected error document.

The counter may be operated as a stand alone device, or on-line, to be controlled and accessed by a host. The control network of the apparatus provides information on piece counts without reference to denomination designation, information pertaining to the count of each denomination, the total value of each denomination counted, the grand total value, completed batches, encountered errors, and counterfeit suspect documents. The present invention is designed to provide a document counter that electronically monitors, controls and records the counting and batching of documents.

In accordance with one aspect of the present invention, a document counting and batching apparatus is provided with a control system governed by a programmable microprocessor. The microprocessor is connected to a multi-channel analog-to-digital (A/D) converter which samples the analog signals from optical and magnetic document sensing devices. As each document is processed, the microprocessor accumulates a plurality of sample values from the sensors via the A/D converter. The accumulated sensor values are compared with programmable thresholds and/or limit values in order to verify each document as it is transported through the apparatus. The threshold and limit values used to verify the documents are each selected by the user or easily reprogrammed for verification of different types of documents. Such reprogramming may, for example, be facilitated by replacement of a non-volatile memory containing verification parameters and a control program executed by the microprocessor.

The microprocessor in the preferred embodiment includes internal registers and is connected to a random access memory for maintaining (i) a piece count of documents counted, (ii) a denomination piece count of each denomination of document counted, and (iii) a denomination value count of the total value of each document counted. A control network is provided for computing the grand total value of all documents counted when the grand total value is requested.

According to another aspect of the invention, the document counting apparatus incorporates a magnetic document verification system which incorporates features for reducing the influence of noise. The magnetic document verification system employs magnetic read head for producing an induced electrical signal in response to the passage of a document having a magnetic property by the head. The magnetic head is rigidly mounted to a document guide plate. A magnet for magnetizing the documents is also rigidly mounted in a fixed relationship to the magnetic read head to form a unitary mechanical linkage with the read head. As documents are transported along the guide plate, a path constricting roller positioned above the read head causes the documents to pass adjacent the magnetic read head at a uniform proximity thereto. A signal conditioning circuit processes the induced electrical signal from the read head to provide a conditioned signal having a low noise content. The signal conditioning circuit preferably includes a bandpass filter for removing both high and low noise components of the induced electrical signal from the magnetic read head. During the passage of a document past the magnetic read head, multiple samples of the processed signal are taken by an analog to digital converter to produce a value which is accumulated by the microprocessor. After the document has passed the read head, the accumulated value is averaged and compared to a predetermined value in order to verify the document as possessing predetermined desired magnetic characteristics or properties.

BRIEF DESCRIPTION OF THE DRAWINGS

The foregoing summary, as well as the following detailed description of a preferred embodiment of the present invention, will be better understood when read in conjunction with the appended drawings, in which.

DETAILED DESCRIPTION OF THE PREFERRED EMBODIMENT

Figure 1:
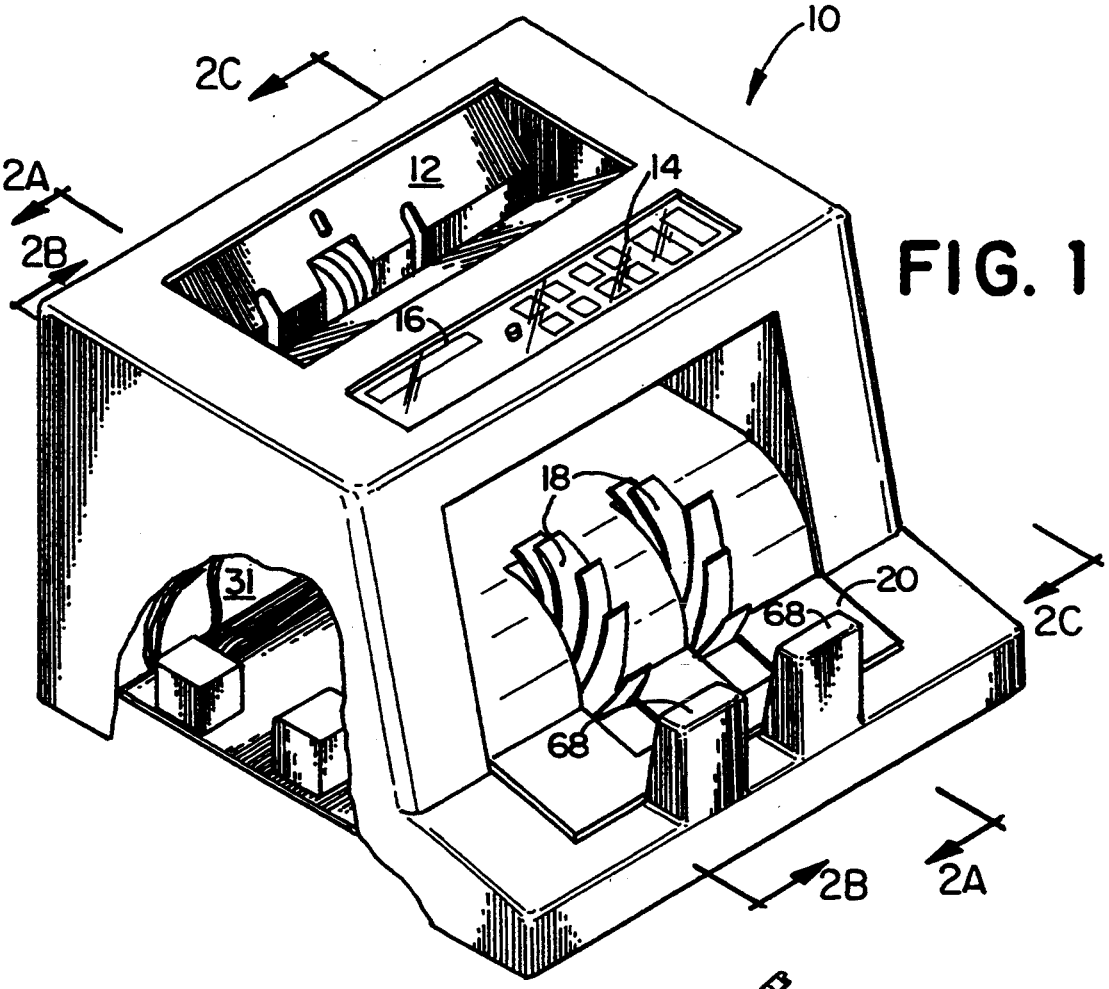
FIG. 1 is a perspective view of a document counting and batching apparatus in accordance with the present invention.

A document counting and batching apparatus 10 is shown in FIG. 1.

In the apparatus 10 of FIG. 1, documents are placed into a hopper 12 whereupon they are fed into the apparatus 10 to be counted or batched. After passing through the apparatus 10, the documents are stacked by stacker wheels 18 onto a stacker plate 20. The apparatus has a control panel which includes a display 16, such as an LCD display, for presenting counting, total, and status information to the user. A keyboard 14 is provided for manually entering control commands to the apparatus.

Figure 2A:
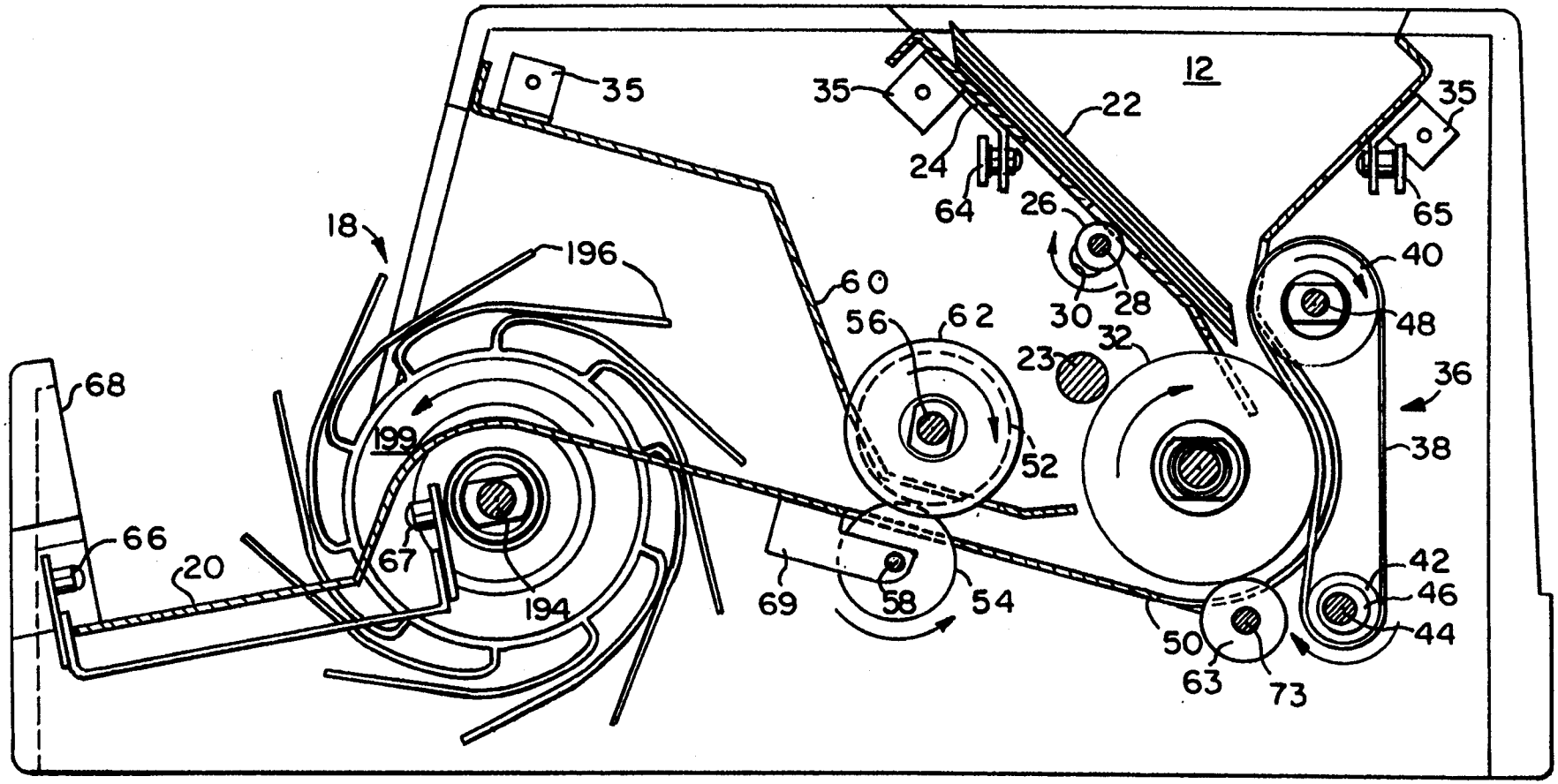
FIG. 2A is a cross-sectional diagram showing the arrangement of mechanical components of the document counting and batching apparatus of FIG. 1 along the line 2A—2A of FIG. 1 with parts broken away.
Figure 2B:
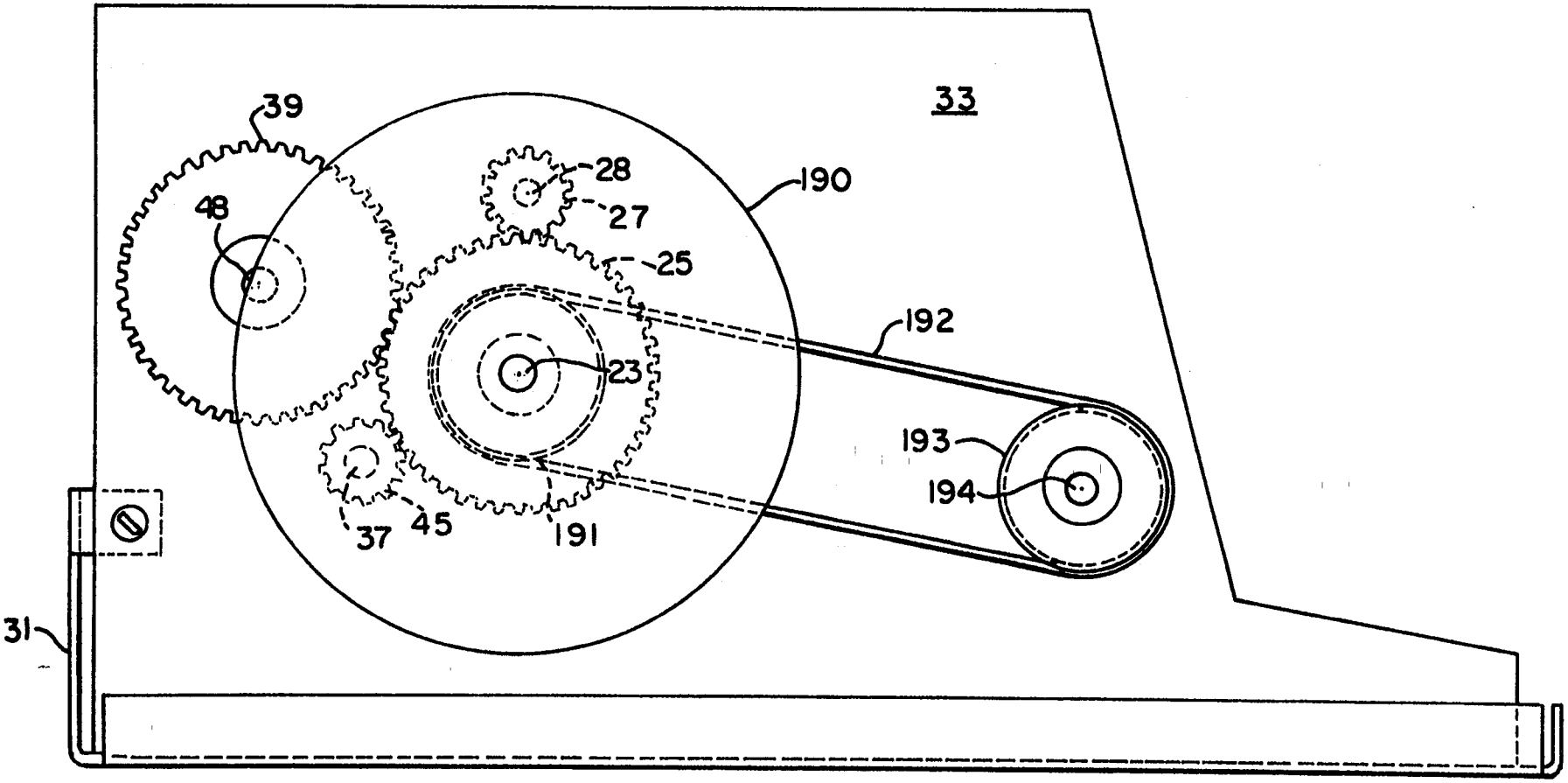
FIG. 2B is a side elevation view of the document counting and batching apparatus of FIG. 1 with the housing removed, taken along the line 2B of FIG. 1.
Figure 2C:
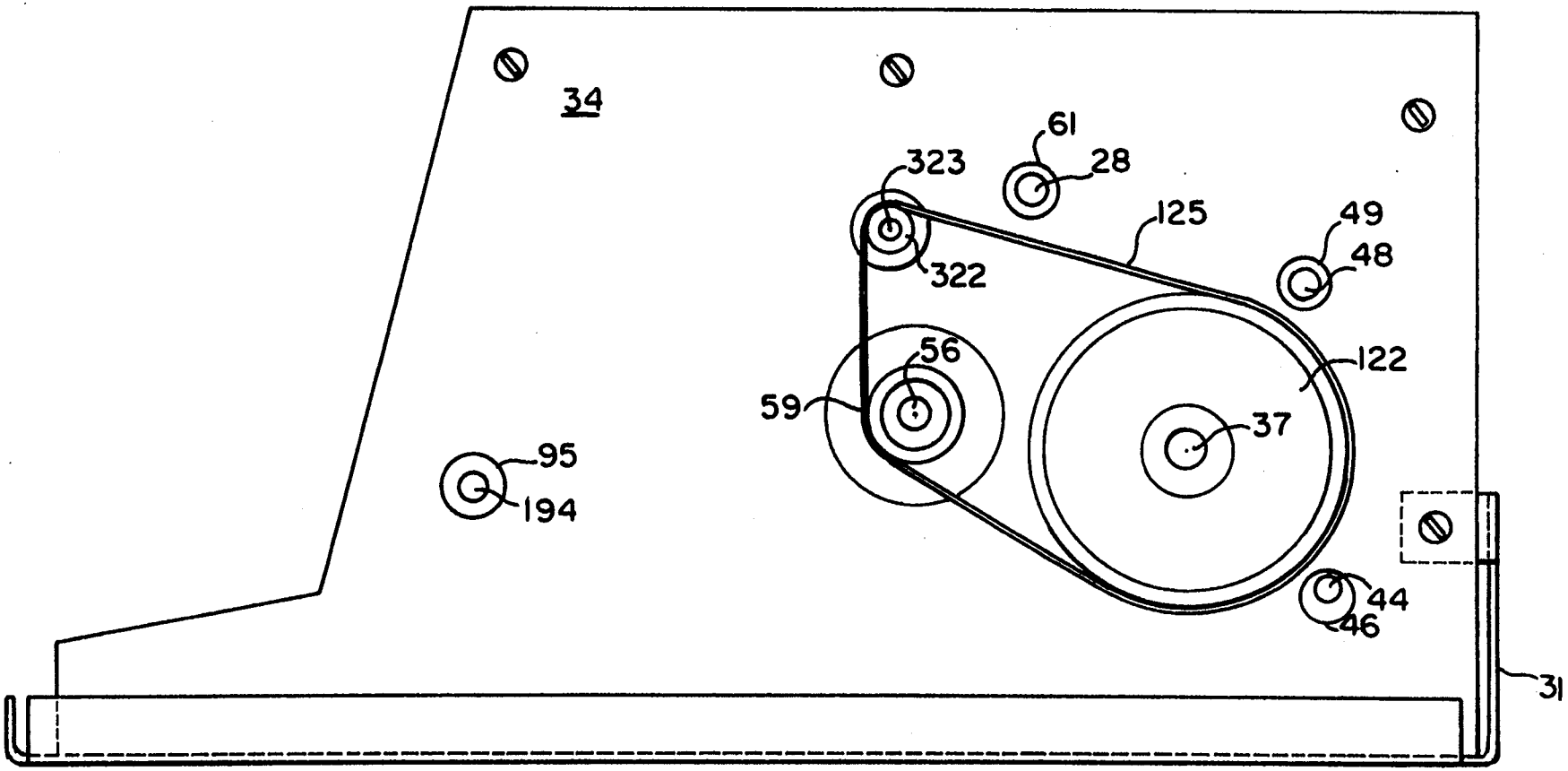
FIG. 2C is a side elevation view of the document counting and batching apparatus of FIG. 1 with the housing removed, taken along the line 2C of FIG. 1.

In regard to the document transport mechanism, referring now to FIG. 2A, a stack of documents 22 is shown placed into the hopper 12 and resting on a hopper plate 24. An LED 65 and photosensor 64 are aligned across the hopper 12 to detect the presence of documents within the hopper 12. A pair of picker rollers, of which picker roller 26 is typical, are mounted upon a picker roller shaft 28 that is located beneath the hopper plate 24. A frictional picker surface 30 extends around a portion of the circumference of the picker roller 26. Upon rotation of the picker roller 26, the picker surface 30 extends through an aperture in the hopper plate 24, frictionally engages the lowermost documents 22, and urges them toward a feed roller assembly 32.

As the feed roller 32 frictionally engages the lowermost documents, a stripper assembly generally designated 36 provides a stripping action in a direction that is counter to the rotation of feed roller 32 so that the documents are shingled and fed through the apparatus one at a time as described more fully hereinafter. The stripper assembly 36 is driven by a drive shaft 48 on which is mounted a drive pulley 40. The drive pulley 40 engages a stripper friction belt 38 which rotates about the drive pulley 40 and an idler pulley 42 mounted on idler shaft 44. The stripper belt 38 is selected to have a lower coefficient of friction with the documents 22 than the peripheral surface of the feed roller 32 so that the stripping action does not overcome the feeding action of the feed roller 32.

It is often the case that the frictional characteristics of documents, such as currency, are dependent upon the age and condition of the documents and upon environmental characteristics, such as humidity. In order to provide adjustment of the stripping friction applied to the documents 22 as they are fed into the apparatus, the idler shaft 44 is provided with rotatable eccentric bearings 46, which may be rotated to adjust the position of the idler shaft 44 relative to the drive shaft 48. Such adjustment alters the tension within the stripper friction belt 38 and may be used to vary the normal force applied to the documents 22 by the stripper friction belt as the documents are fed into the apparatus 10.

Figure 3A:
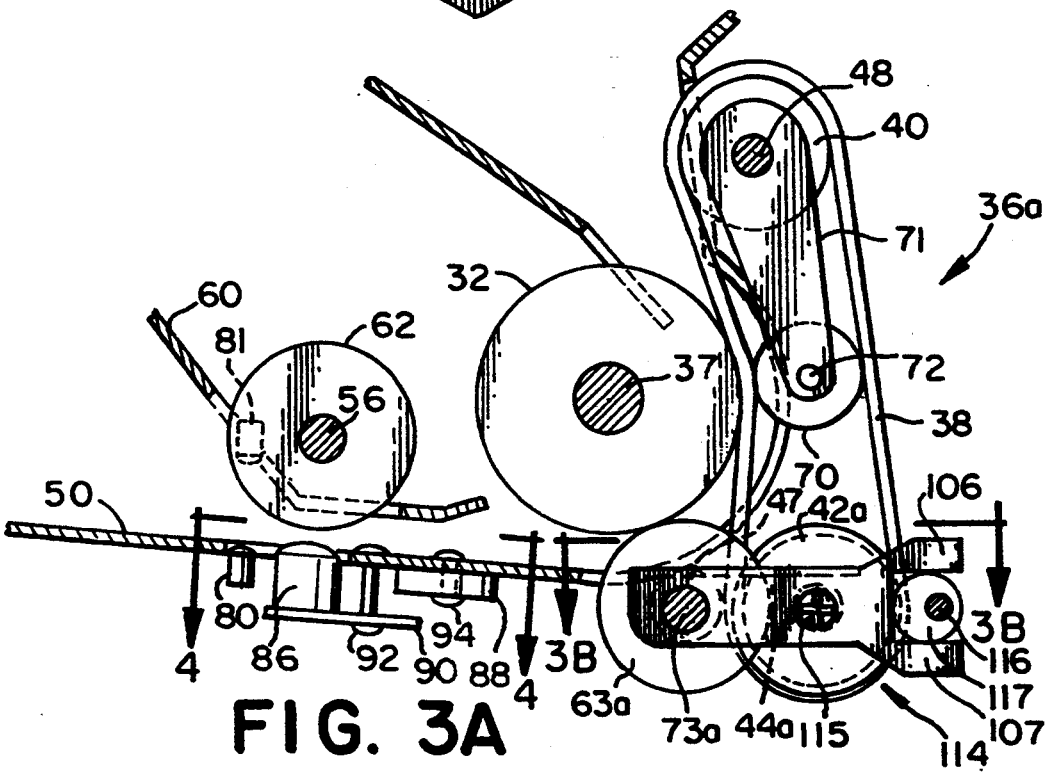
FIG. 3A is a partial cross-sectional diagram showing the location of optical and magnetic sensors within the document counting and batching apparatus of FIG. 2A and showing an alternate stripper assembly with some parts removed for clarity.

A preferred alternative stripper assembly generally designated **36*a* is shown in FIG. 3A. A tension idler roller 70 engages the stripper belt 38 between the drive pulley 40 and an idler collar 42*a*. The tension idler roller 70 maintains tension in the stripper belt 38 by preventing inward deformation of the loop formed by the stripper belt 38 as documents are urged toward the surface of the stripper belt 38. The tension idler roller 70 is mounted upon an axle 72 which is suspended from the stripper drive shaft 48 by a pivotally mounted bracket 71**.

Figure 3B:
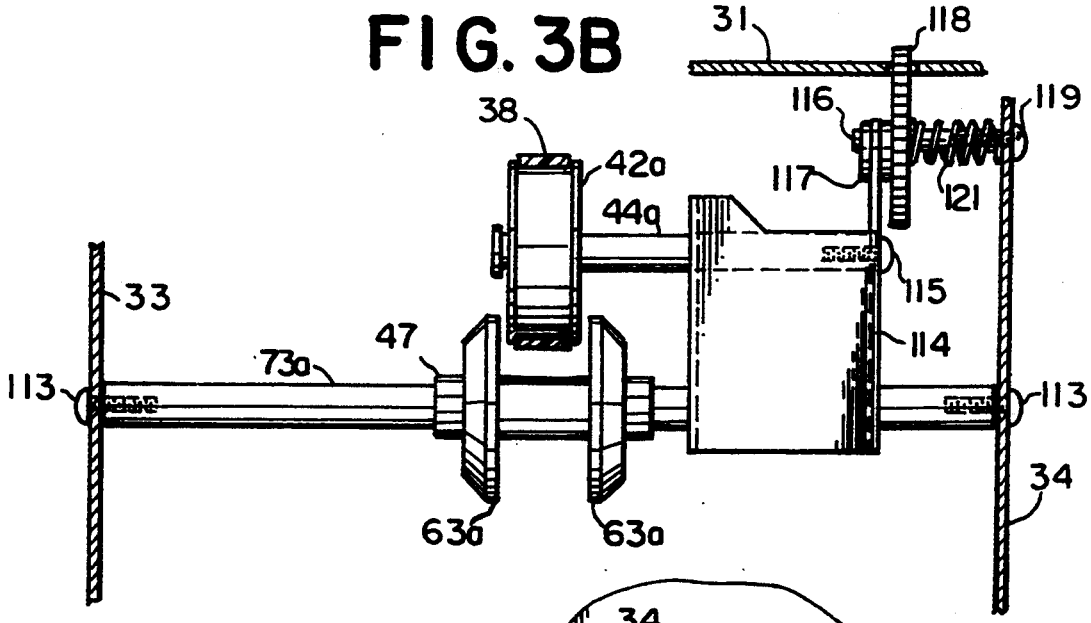
FIG. 3B is a plan view of the stripper adjustment mechanism of the stripper assembly of FIG. 3A taken along the line 3B—3B.

As can be seen in FIG. 3B, an idler collar 47 spins freely upon idler shaft **73*a*. The idler shaft 73*a* is fastened to the side plates 33 and 34 by screws 113. Returning to FIG. 3A, it can be seen that the surfaces of flanges 63*a* contact the surface of feed roller 32 so that documents remain in frictional contact with the feed roller and are advanced between the flanges 63*a* and the feed roller 32 along the guide path. Returning to FIG. 3B, there is shown a bracket generally designated 114 pivotally supported upon the idler shaft 73*a*. A stub shaft 44*a* is fixed to the bracket 114 by a screw 115 at one end of the stub shaft 44*a*. A tension adjusting pulley 42*a* is rotatably mounted upon the stub shaft 44*a* near the end of the stub shaft 44*a* opposite to the screw 115. As best seen in FIG. 3A, the tension adjusting pulley 42*a* engages the lower end of the stripper friction belt 38**.

Figure 3C:
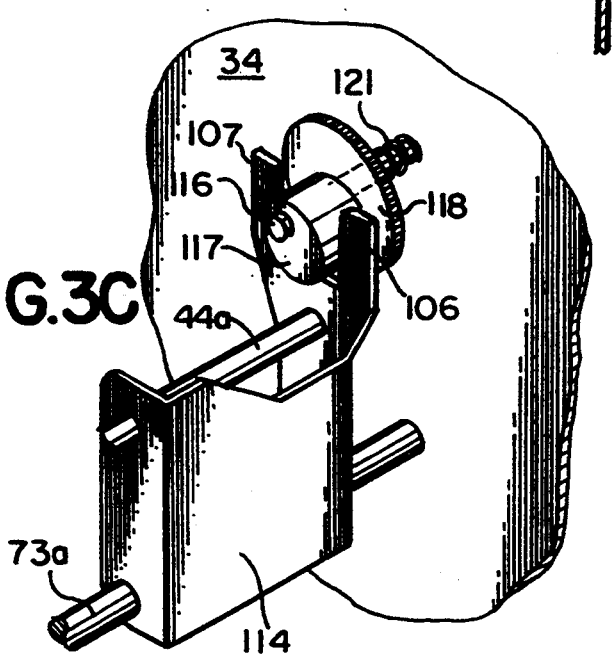
FIG. 3C is a perspective view of the stripper adjustment mechanism of FIG. 3A.

Turning to FIG. 3C, it is shown that the bracket 114 has a pair of jaws 106 and 107 at the opposite end of the bracket 114 with respect to the pivotally mounted end of the bracket 114 upon the idler shaft **73*a*. A cam 117 is eccentrically mounted on an adjustment shaft 116 between the jaws 106 and 107. As can best be appreciated from the view of FIG. 3A, rotation of the cam 117 upon the adjustment shaft 116 causes the jawed end of the bracket 114 to pivot about the pivotally mounted end of the bracket 114 upon shaft 73*a*. As the bracket 114 pivots, the stub shaft 44*a* may be moved vertically up and down by virtue of the mounting of the stub shaft 44*a* to the bracket 114. Vertical translation of the stub shaft 44*a* causes the pulley 42*a* to decrease or increase the tension in the stripper belt 38 as the pulley 42*a* is respectively moved up or down. Accordingly, it should be appreciated that the cam 117 is captured or held by the bracket to pivot the bracket about idler shaft 73*a***, and other arrangements, other than the jawed end, could be employed for capturing the cam by the bracket.

Returning to the view of FIG. 3B, it is shown that the adjustment shaft 116 is attached to the side wall 34 by a screw 119. Rotation of the cam 117 is preferably effected by rotating a thumbwheel 118 which rotates freely upon the adjustment shaft 116 and may be mounted to the cam 117 or formed of a single piece with the cam 117. The thumbwheel 118 preferably extends through a slot in the rear 31 of the apparatus for easy access thereto. When the stripper belt 38 is set to the desired tension, the position of the thumbwheel 118 is frictionally maintained by compression spring 121 which is mounted upon adjustment shaft 116 between the thumbwheel 118 and the side wall 34.

The functional relationships among the mechanical parts of the apparatus 10 may be appreciated from the views of FIGS. 2A–2D. A document guide plate 50, as shown in FIG. 2A, is connected to side plates 33 and 34 in a well known manner, such as by L-shaped brackets of which bracket 35 is typical.

The picker shaft 28 is provided in journaled bearings 61 in side plates 33 and 34, with two pickers 26 thereon. The picker shaft 28 has a gear 27 thereon, which is engaged with an idler gear 25 on idler shaft 23, which is journaled in bearings 29 in plates 33 and 34.

The idler gear 25 is engaged with a stripper gear 39, on stripper drive shaft 48, which is journaled in bearings 49 in side plates 33 and 34.

The stripper drive shaft 48 has a centrally located stripper drive pulley 40 keyed thereto. A stripper friction belt 38 is engaged with drive pulley 40 and with an idler pulley 42 on an adjust shaft 44.

A tension idler roller 70 is mounted on a bracket 71, which is supported by and free to pivot on shaft 48 in a fashion similar to that shown in Technitrol U.S. Pat. No. 4,416,449 issued on Nov. 22, 1983, the disclosure of which is incorporated herein by reference.

The adjust shaft 44 is engaged with side plates 33 and 34 by eccentric bearing members 46, of well known type, which are rotatable and fixed in desired positions to impart a desired tension on stripper friction belt 38.

Figure 2D:
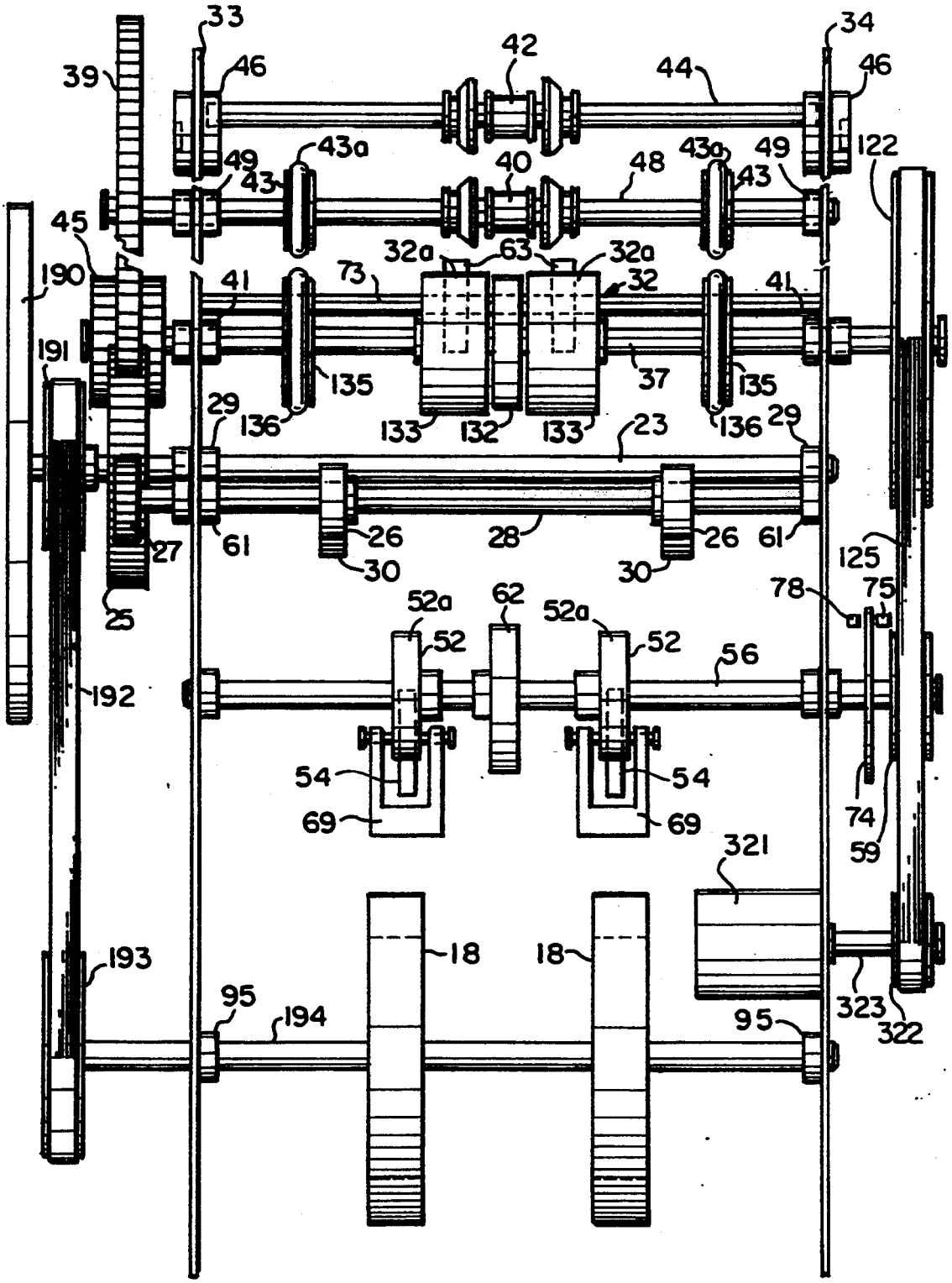
FIG. 2D is a diagrammatic plan view showing the drive train of the apparatus of FIG. 1 with the guide plates removed, the side plates broken, and overlapping parts separated for clarity.

The drive shaft 48 has a pair of pulleys 43 thereon, as shown in FIG. 2D, outboard from pulley 40 and keyed thereto, with O-rings **43*a* thereon for frictional engagement with the sheets of documents 22. The document guide plate 50 is slotted (not shown) to permit the O-rings 43*a* to contact the documents 22. The pulleys 43 are rotated counter to the direction that documents are fed into the apparatus so that the O-rings 43*a*** provide additional stripping action.

The outer surface of the stripper friction belt 38 contacts idler collar 132 of the feed roller assembly 32 when there are no documents present between the feed roller assembly 32 and the stripper friction belt 38. The feed roller assembly 32 is keyed to feeder shaft 37, which is journaled in bearings 41 in side plates 33 and 34.

As shown in FIG. 2D, the feed roller assembly 32 includes central idler collar 132 and feeder pulleys 133 on each side keyed to shaft 37. The feeder pulleys 133 have outer friction linings **32*a* for frictionally engaging the documents as they are advanced by the pickers 26. The idler collar 132 rotates freely upon the feeder shaft 37 and the surface of the idler collar 132 is recessed relative to the feeder pulleys to accommodate the counter-rotation of the stripper friction belt 38**.

The feeder shaft 37 has a pair of additional feed rollers 135, keyed thereto with O-rings 136 thereon, for frictional engagement with documents 22. The feeder shaft 37 has a gear 45 which is engaged with idler gear 25.

The feeder shaft 37 at its end opposite to gear 45 has a drive pulley 122 keyed thereto. A timing belt 125 is engaged with the drive pulley 122 and with a motor pulley 322 on output shaft 323 of a driving motor 321 mounted to side plate 34 as is best appreciated from the view of FIG. 2C.

The driving motor 321, shown in FIG. 2D, is of conventional type and connected by motor control circuitry as described hereinafter to a source of electricity (not shown).

The timing belt 125 is also engaged with a pulley 59 on an accelerator shaft 56, which is journaled in bearings in side plates 33 and 34. The accelerator shaft 56 has a pair of accelerator collars 52 thereon, which are keyed thereto and have smooth, outer gripping surfaces **52*a* to grip and accelerate documents, as described more fully hereinafter. A path constricting roller 62 is keyed to the central portion of the accelerator shaft 56**.

The timing belt 125 is of the ridged type, which provides positive, non-slip driving between the motor 321 and pulleys 122 and 59.

A pair of accelerator idler rollers 54 are provided in contact with surfaces **52*a* of collars 52 and mounted upon an accelerator idler shaft 58. The accelerator idler shaft 58 is held by spring loaded carriage assemblies 69** which are mounted to the underside of the document guide plate.

The accelerator collars 52 and roller 54 grip each document and accelerates each document to provide a gap between the documents, and to feed each document sequentially to the stacker wheel 18. The path constricting roller 62 urges documents against a magnetic sensor, as described more fully hereinafter.

The accelerator shaft 56 has a timing disc 74 of well known type thereon, keyed thereto, and with an LED/-photosensor pair 75 and 78 of well known type, such as the HOA1870-31 detector available from Honeywell mounted adjacent thereto. The photosensor 78 scans the timing disc 74, and provides a timing pulse to a central processor as described hereinafter for each predetermined incremental movement of the disc 74. The preferred incremental distance at which timing pulses are provided by the photosensor 78 upon movement of the disc 74 is equivalent to approximately one millimeter of movement of the surface of the acceleration rollers **52*a***.

The idler shaft 23 has an overrunning flywheel assembly 190 thereon, of well known type, which includes a pulley 191, of well known type, with a belt 192 engaged therewith and which pulley continues to rotate after shaft 23 is stopped by virtue of a conventional one-way clutch mechanism (not shown).

The belt 192 is engaged with a pulley 193 on stacker shaft 194, which is journaled in bearings 95 mounted in side plates 33 and 34.

The stacker shaft 194 has a pair of stacker wheels 18 keyed thereto which stack documents D on stacker plate 20.

The stacker wheels generally designated 18 have a drum portion 199, which is mounted to the shaft 194. The drum portion has a plurality of separated curved fingers 196 raised above and extending therefrom at an angle, the fingers receiving the documents from the accelerator collars 52 and stacking the documents one at a time on the plate 20.

The stacker plate 20 is also provided with a pair of separated vertically extending documents stops 68 against which documents are stacked.

Returning to FIG. 2A, it can be seen that after the stripping action on the documents, the documents are then advanced between the feed roller 32 and an idler roller 63 mounted upon an idler shaft 73. The idler roller 63 serves to maintain the frictional engagement of the documents with the surface of the feed roller 32 as the documents are advanced by the feed roller 32 toward acceleration roller 52 mounted upon acceleration shaft 56. The acceleration roller 52 forms a nip with acceleration idler roller 54 mounted upon acceleration idler shaft 58. Acceleration roller 52 and acceleration idler roller 54 increase the speed of the document to provide a spacing between documents advanced by the feed roller 32. Acceleration rollers 52 and 54 are positioned closely enough toward the feed roller 32 and the idler roller 63 along lower guide plate 50 so that documents are in continuous sequential contact with the nip between the feed roller 32 and the idler roller 63, the acceleration rollers 52 and 54, and then the fingers of the stacker wheel 18. Such continuous contact obviates reliance upon inertial drift of the documents to provide controlled transport through the apparatus.

After having been accelerated, documents continue along lower guide plate 50 toward the stacker wheel 18. The periphery of the stacker wheel 18 possesses a plurality of extended fingers 196 which lift documents from the lower guide plate 50 and place them upon the stacker plate 20. An LED 67 and a photosensor 66 are aligned across the stacker plate 20 to detect the presence of documents upon the stacker plate 20. The photosensors 64 and 66 may be photodiodes, phototransistors, or other equivalent devices.

In regard to sensing the documents as the documents pass through the apparatus, several control and computational operations are carried out by an apparatus control network as documents pass through the apparatus. In order to provide an accurate count of acceptable documents, the apparatus incorporates means for detecting misfed documents or documents which do not satisfy predetermined fitness or authenticity criteria, collectively referred to hereinafter as error documents or counterfeit suspect documents. The apparatus is halted upon detection of a misfed or unfit document so that the user may remove the error document. A message indicating the type of error is shown on the display 16 upon detection of the error document. Misfeed error document include chains, which are partially overlapping documents, and doubles, which are completely overlapping documents. Chains are detected according to a length error which is generated due to their unusual length relative to other documents of the same type. Doubles are detected according to an opacity error which is generated due to their unusual opacity relative to other documents of the same type. Fitness error documents include documents of improper dimensions and suspected counterfeit documents. Referring to the dimensions of the document 100 shown in FIG. 4, a "half" error is defined as failure to exceed a predetermined length threshold in the direction of the X-axis and an "off-width" error, sometimes referred to as a "short" error, is defined as failure to exceed a predetermined width threshold in the direction of the Y-axis, as indicated in connection with the document 100 in FIG. 4.

Figure 4:
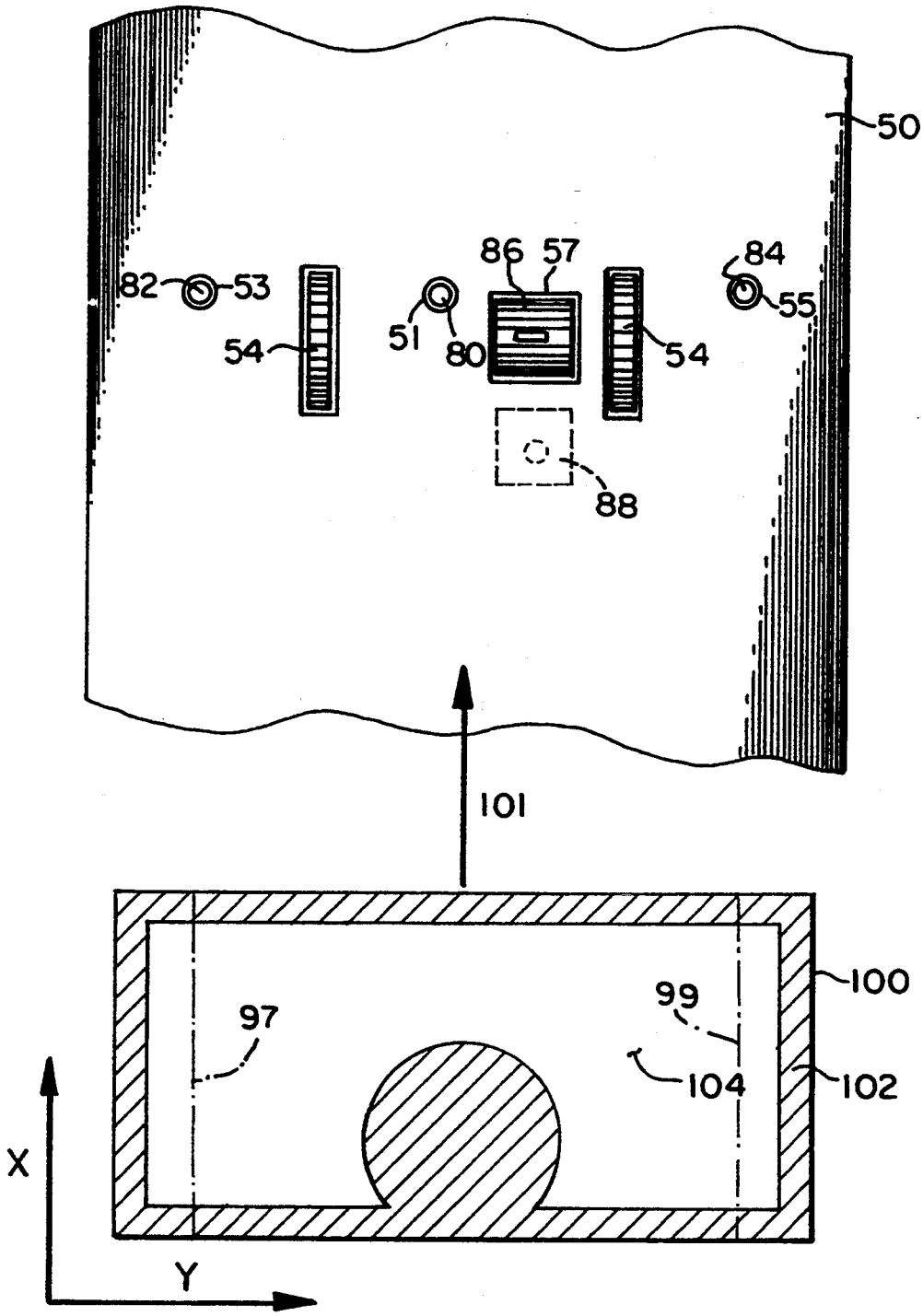
FIG. 4 is a sectional plan view of the guide plate showing the location of optical and magnetic sensors of FIG. 3 as viewed along line 4—4.

Several transducers are employed as part of the apparatus control system to sense characteristics of documents passing through the apparatus in the vicinity of acceleration rollers 52 and 54. As shown in FIG. 3A, a light source, such as center LED 81 is positioned above the lower guide plate 50 near the center of the document guide path. The center LED 81 emits light which is detected by an optical sensor such as center sensor 80 mounted beneath the lower guide plate 50 to provide optical detection of the presence of a document passing between the LED 81 and the sensor 80. As shown in FIG. 4, the center sensor 80 is mounted within an aperture 51 in the lower guide plate 50. A left sensor 82 is mounted within an aperture 53 located toward the left side of the lower guide plate 50. A right sensor 84 is mounted within an aperture 55 toward the right side of lower guide plate 50. The left and right sensor 82 and 84 are used to detect both the presence and the opacity of the left and right side segments (generally designated 99 and 97 by the lines in FIG. 4) of the documents sensed by the sensors, as the documents are transported along the lower guide plate 50 adjacent the sensors. The left sensor 82 and the right sensor 84 cooperate with respective left and right LED's 83 and 85 shown in FIG. 6A. The LED's 83 and 85 are mounted within the upper guide plate in an arrangement similar to that of center LED 81 and center sensor 80 described in connection with FIG. 3A. It is noted that the relative positions of LED's and phototransistors in the upper and lower guide plates, respectively, may be reversed without affecting the detection of documents passing therebetween. It is further noted that light sources other than LED's and optical detectors other than phototransistors may alternatively be employed to obtain the detecting and sensing functions described herein. Lastly, it is noted that the left, right, and center photosensors are shown in FIG. 4 to be located on a line transverse or perpendicular to the guide path for the documents, although a different orientation of the sensors could be employed.

Magnetic sensing of the documents passing through the apparatus is also provided. Returning to FIG. 3A, a magnetic field detector, such as read head 86, is mounted upon a circuit board 90 beneath the guide plate 50 and positioned to protrude slightly above the surface of the lower guide plate 50. The read head 86 is preferably a single full-track head manufactured by Michigan Magnetics Inc. of Vermontville, Mich., having a nominal inductance of 300 mH, an impedance of 2 kΩ at 1 Khz, and a DC resistance of 270 Ω. The read head 86 provides an electrical signal indicative of the magnetic characteristics or magnetic property of documents proceeding along the lower guide plate 50. In order to intensify the induced electrical signal, a flux source, such as permanent magnet 88, is positioned below the lower guide plate 50 to magnetize documents prior to their passage above the read head 86.

Mechanical vibration within the apparatus tends to introduce unwanted variations in the electrical signal at the read head 86, which may be due to vibrations inducing fluctuation in the relative positioning of the magnet 88, the read head 86 and the documents passing above the read head 86. In order to minimize vibration of the magnet 88 relative to the read head 86, the magnet 88 and the read head 86 are mounted in a rigid, fixed relationship to form a single mechanical unit. For example, in the preferred embodiment, the circuit board 90 is attached to the lower guide plate 50 by a rigid mounting, such as stud 92, and magnet 88 is also attached to the lower guide plate 50 by a rigid mounting, such as stud 94. Mounting both the read head 86 and the magnet 88 to the lower guide plate 50 constrains vibration or movement of the head 86 and the magnet 88 relative to each other. Alternatively, it is noted that the magnet 88 may be rigidly mounted to the circuit board 90 upon which the read head 86 is also mounted.

In order to minimize distance variations between documents and the read head 86, the path of the documents above the read head 86 is constrained by a path constricting roller 62 which is keyed to the accelerator shaft 56. The surface of the path constricting roller extends beneath the upper guide plate 60 to form a narrow gap in the vicinity of the read head 86. The narrow gap formed between the path constricting roller 62 and the read head 86 ensures that documents which pass over the read head 86 are substantially uniformly sensed or scanned by the read head 86 for accurate detection of counterfeit suspect documents. The path constricting roller 62 provides uniform magnetic sensing of documents without causing jamming of documents having curled edges as often occurs in prior art devices employing a stationary path constricting member to perform a similar function.

The position of the read head 86 relative to the optical sensors 80, 82, and 84 is shown in FIG. 4. The read head 86 protrudes through an aperture 57 in the lower guide plate 50 at a position that is slightly forward of the optical sensors 80, 82 and 84 with respect to the document transport direction as indicated by arrow 101. A document, such as a dollar bill generally designated 100, is transported along the lower guide plate 50 in the direction indicated by arrow 101. United States bills, such as bill 100, are characterized by a central non-magnetic portion 104 and a peripheral magnetic ink bearing portion 102. Thus, as the dollar bill 100 passes over the read head 86, the induced electrical signal produced by the read head 86 will be characterized by two periods of irregular activity indicative of the passage of the leading and trailing peripheral areas of the magnetic ink bearing portion 102 of the dollar bill 100.

Figure 5A:
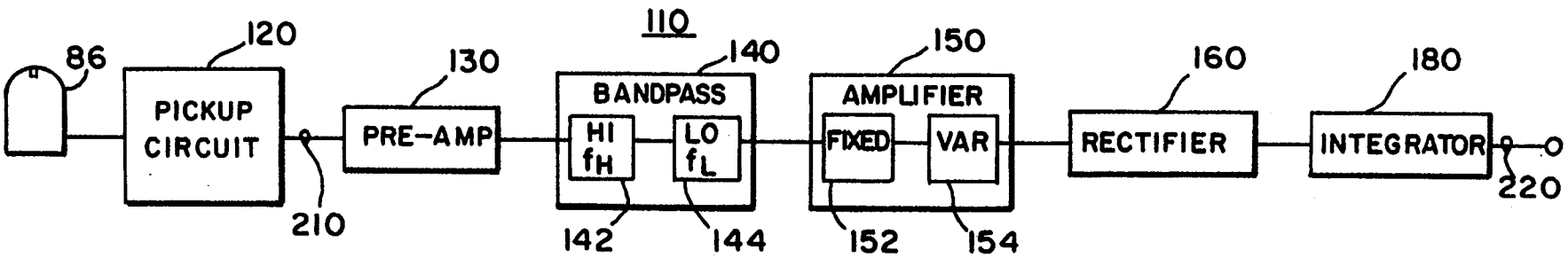
FIG. 5A is a schematic block diagram of a magnetic signal conditioning circuit in accordance with the present invention.
Figure 5B:
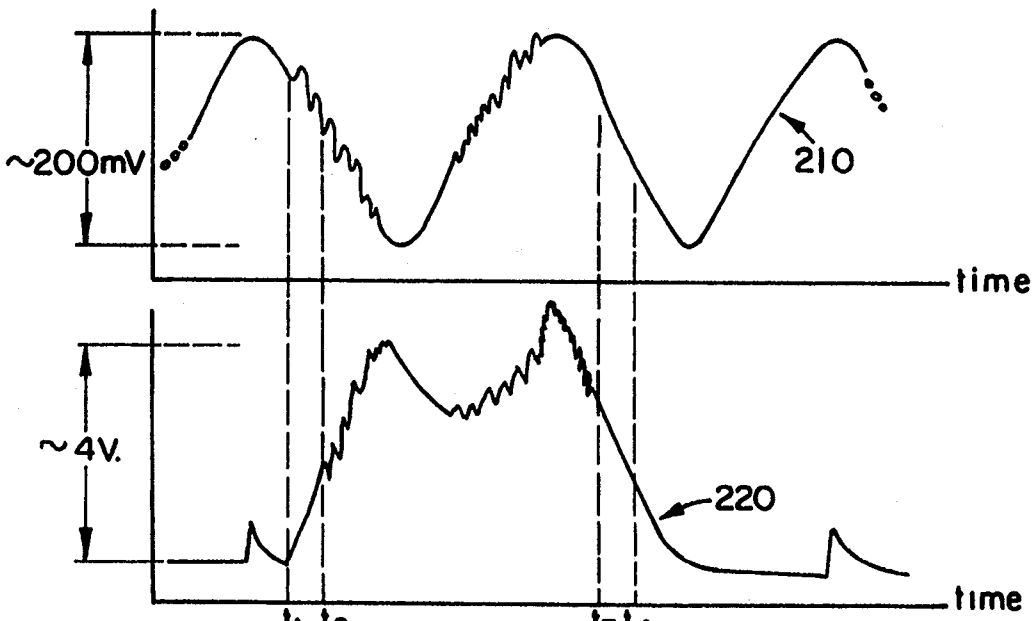
FIG. 5B is a graphical representation of the input and output waveforms of the circuit of FIG. 5A.

The electrical signal generated by the read head 86 in response to the passage of a document is processed by a magnetic signal conditioning circuit 110 shown in FIG. 5A. The conditioning circuit 110 performs several signal processing functions to extract and amplify the component of the electrical signal from the read head 86 into a form suitable for analog-to-digital conversion. The read head 86 is connected to a pickup circuit 120. The pickup circuit 120 produces a pickup signal 210, a typical pickup waveform which is shown in FIG. 5B. The pickup signal 210 is dominated by 60 Hz, 200 Mv peak-to-peak leakage noise from the apparatus power supply. For clarity of exposition, noise components of signal 210 due to vibration and electronic noise from the motor are not shown. Time $t_1$ indicates time at which the leading edge of a document having a magnetic ink bearing periphery begins to pass over the read head 86. The pattern of ink upon the document causes a low-amplitude oscillation of the pickup signal 210 having frequency components significantly in excess of 60 Hz. The low amplitude oscillation exhibits a momentary decrease during passage of the non-magnetic portion of the document over the read head. After passage of the non-magnetic portion of the document, the low-amplitude oscillation is again present in the pickup signal 210. Time $t_3$ indicates the time at which the trailing edge of the document passes over the read head 86 and the low-amplitude oscillation ceases. The frequency content of the low-amplitude oscillation caused by passage of a document is significantly below the frequency range of vibration noise and motor noise.

Returning to FIG. 5A, the pickup signal 210 is passed to a pre-amplifier stage 130 which amplifies the pickup signal to a level suitable for extracting the low-amplitude oscillation caused by the magnetic ink bearing portion of the document. The pre-amplified signal is then passed to a bandpass filter 140. The lower and upper corner frequencies of the bandpass filter are selected to substantially eliminate the low frequency power supply noise and the high frequency vibration and motor noise from the pre-amplified signal. A pass band ranging from about 250 Hz to about 1600 Hz has been found to be suitable for this purpose. The bandpass filter 140 may be a single stage bandpass amplifier or a two-stage amplifier incorporating in series a high-pass stage and a low-pass stage.

Once the desired frequency range has been extracted by the bandpass filter 140, the filtered signal is passed to a second amplifier stage 150. The second amplifier stage 150 amplifies the filtered signal to a level suitable for analog to digital conversion and ultimately for threshold evaluation. The second amplifier 150 preferably incorporates both a variable gain stage 154 and a fixed gain stage 152. The variable stage 154 is provided so that the gain of amplifier 150 may be adjusted to compensate for a variation in the pickup signal amplitude. Such as variation may be induced by a change in the operating speed of the apparatus.

After having been amplified to a suitable level for digital conversion, the amplified signal is passed to a rectifier 160 which rectifies the amplified signal so that subsequent integration will produce a positive value. The rectified signal is then passed to an integrator 180 which integrates the rectified signal. The integrator is designed to have a finite integration time. The finite integration time of the integrator 180 reduces the sensitivity of the conditioning circuit 110 to momentary fluctuations of the rectified signal so that digital sampling of the integrated signal will yield a sample value that is representative of the magnetic characteristic or property of the document being sensed over a finite time period. The finite integration time of the integrator 180 also compensates for the time lag between magnetic and optical sensing due to the staggered relative positions of the read head 86 and the optical sensors 80, 82, and 84 along the lower guide plate 50. A further benefit obtained by the integrator is that the integrated signal does not fall to zero during the time that the non-magnetized portion of a document is present over the read head 86. The upper limit of acceptable integration time is determined by the temporal spacing between documents which are fed through the apparatus. The integration time must be short enough to allow the integrated signal to decay so that there is no carryover of integrated signal amplitude between successive documents. An integration time on the order of 2 ms has been found to be suitable for document counting speed of about 1200 documents per minute.

The integrated signal produced by the integrator is shown in FIG. 5B as conditioned signal 220. The conditioned signal 220 is characterized by two peak values of about 4 V which are substantially concurrent with the passage of the magnetized peripheral portion of a document over the read head 86. As can be seen by comparison of the pickup signal 210 with the conditioned signal 220, the influence of the 60 Hz power supply noise is reduced to occasional spikes in the conditioned signal 220. The time period between $t_1$ and $t_3$ during which a document passes over the read head 86 is discernable by the large-scale rise and fall of conditioned signal 220. The time period during which the document is above the optical sensors 80, 82, and 84 occurs during the interval between $t_2$ and $t_4$. The optical detection interval lags slightly behind the magnetic detection interval between $t_1$ and $t_3$. The finite integration time of the integrator 180 ensures that the conditioned signal 220 maintains a significant positive amplitude concurrently with the optical detection interval.

Figure 5C:
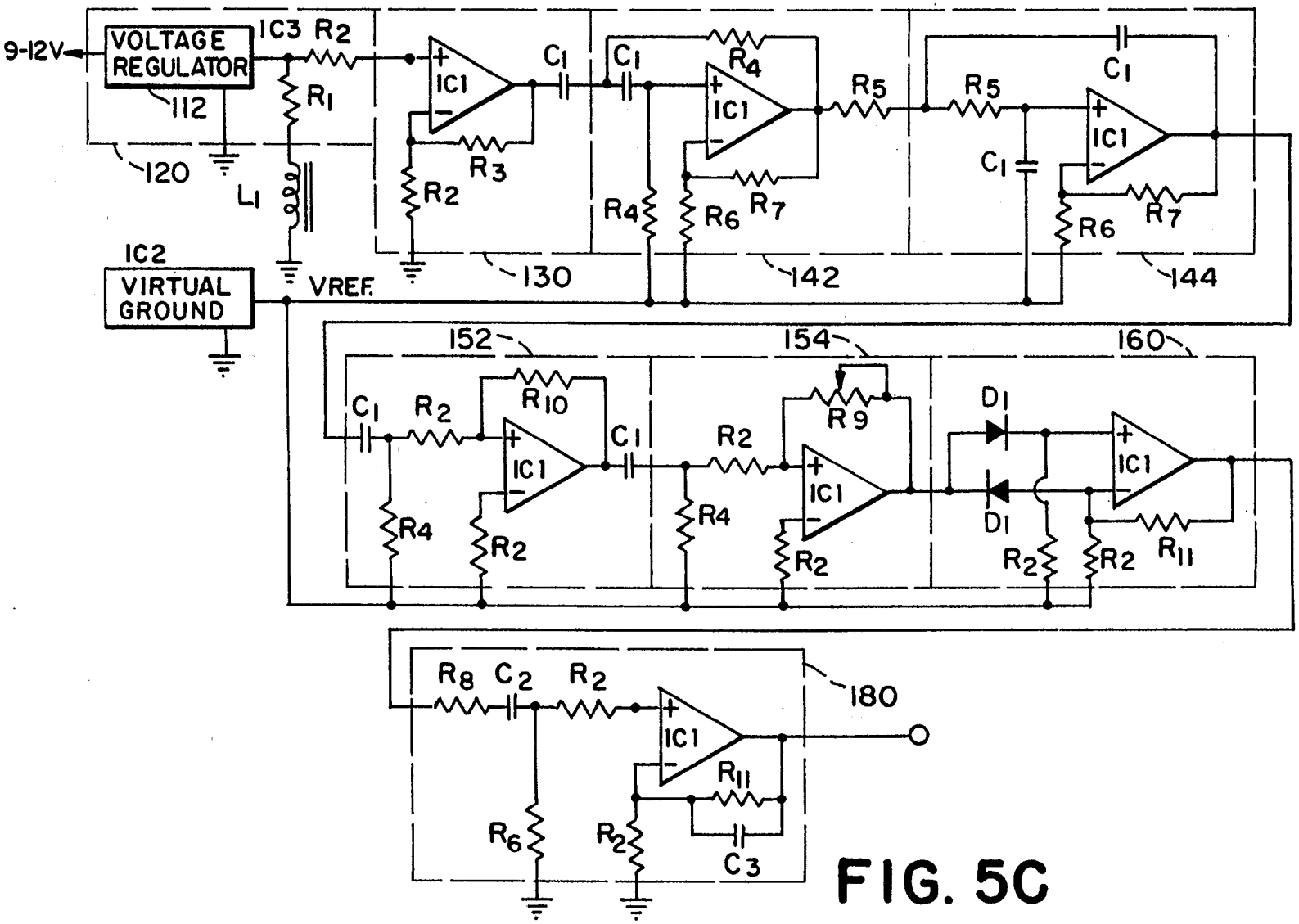
FIG. 5C is a schematic diagram of a preferred embodiment of the circuit of FIG. 5A.

A detailed schematic circuit diagram of the conditioning circuit 110 is shown in FIG. 5C. The circuit 110 incorporates several linear operational amplifier stages preferably based upon LM324 op-amp circuits in order to accomplish the signal processing functions described in connection with FIG. 5B. The preferred component values pertaining to the conditioning circuit 110 are listed in Table I. The detailed operation of the conditioning circuit 110 shown in FIG. 5C will be apparent to those skilled in the art. To further enhance isolation from sources of electrical noise, a reference voltage is supplied from a virtual ground, such as a TLE2425 virtual ground, to the bandpass filter stages 142 and 144, amplifier stages 152 and 154, and the rectifier 160. The read head 86 is biased by a voltage regulator, such as an LM7805 DC regulator within the pickup circuit 120.

TABLE I

| Signal Conditioning Circuit Component Values | | |
|---|---|---|
| R1 - 20 KΩ | C1 - .01 μF | D1 - 1N914 |
| R2 - 10 KΩ | C2 - 1.0 μF | IC1 - LM324 |
| R3 - 330 KΩ | C3 - .10 μF | IC2 - TLE2425 |
| R4 - 75 KΩ | L1 - 300 mH | IC3 - LM7805 |
| R5 - 10 KΩ | | |
| R6 - 47 KΩ | | |
| R7 - 27 KΩ | | |
| R8 - 220 Ω | | |
| R9 - 100 KΩ pot. | | |
| R10 - 1 MΩ | | |
| R11 - 100 KΩ | | |

Control Network

Figure 6A:
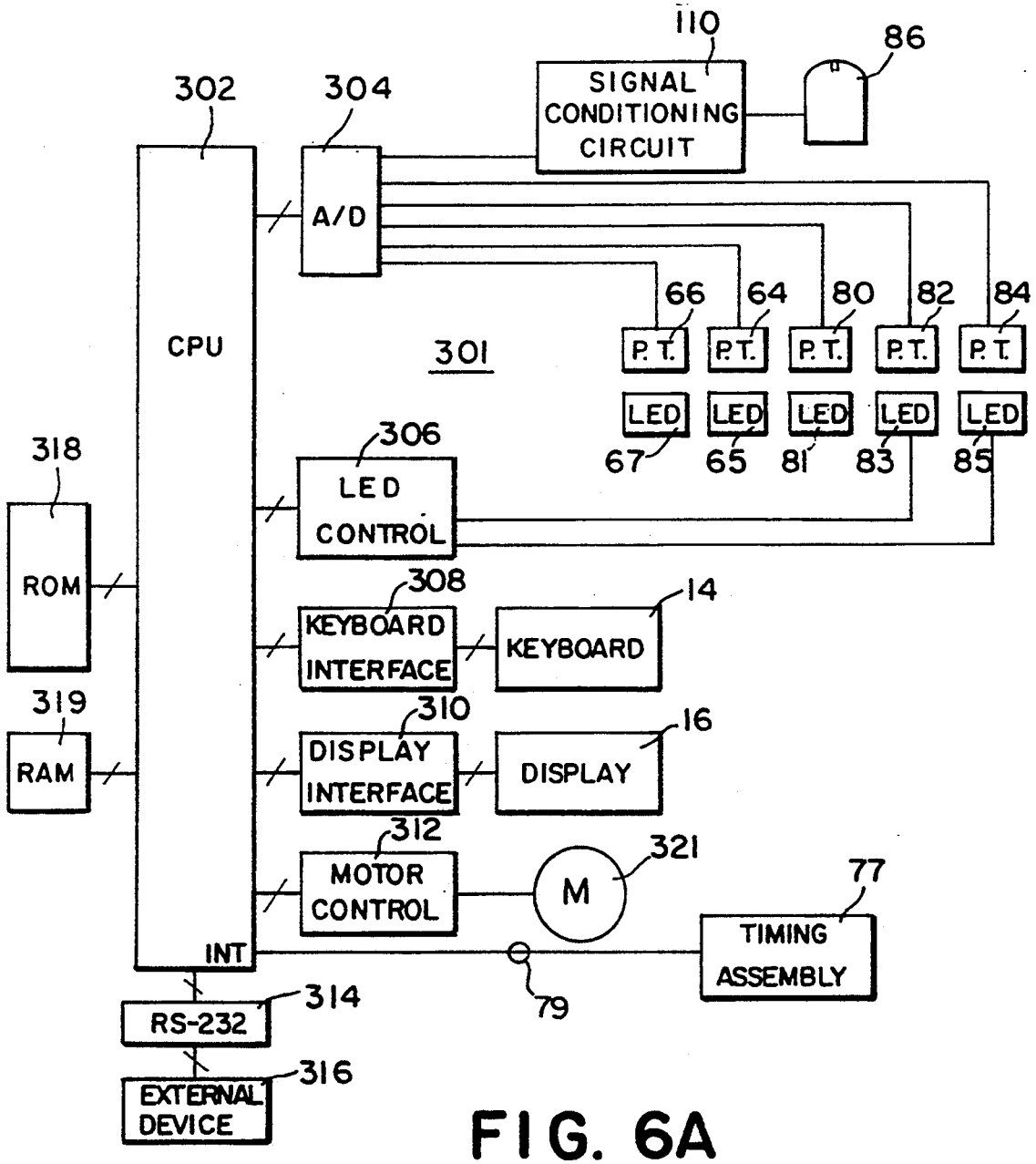
FIG. 6A is a schematic block diagram of a control system for the document counting and batching apparatus according to the present invention.

Operation of the counting and batching apparatus is monitored and governed by a control network 301 as shown in FIG. 6A. A microprocessor, such as CPU 302, executes a control program stored in a non-volatile memory, such as ROM 318. The control program coordinates the functions of counting, batching, document testing, motor control, display control, user input, and communication with external devices. The CPU 302 is preferably a μPD78C10 manufactured by Nippon Electric Company. The CPU 302 is connected to a random access memory, RAM 319, having a number of registers for storing and retrieving information during execution of the control program. The RAM 319 may be an external RAM or may be monolithically integrated with the microprocessor. The CPU 302 is connected to a multichannel analog-to-digital (A/D) conversion circuit 304. In the preferred embodiment A/D circuit 304 is monolithically integrated with the CPU 302. The A/D circuit 304 receives analog signals from the sensors 66, 64, 80, 82, and 84, and from the magnetic signal conditioning circuit 110 and provides to the CPU 302 digital signals that correspond to the various analog signals.

An LED control circuit 306 is connected between the CPU 302 and the LEDs 83 and 85. The LED control circuit is a multi-channel digital-to-analog converter which adjusts the brightness of the LEDs in response to signals received from the CPU 302. Variation of LED brightness levels is particularly important to the operation of the right and left sensor circuits 82 and 84 since those circuits are used to determine both the presence and the opacity of documents passing through the apparatus. The light level required for opacity testing can be much greater than the light level required for detecting the presence of a document. Since LED reliability decreases with increasing brightness, it is desirable to operate the left and right LEDs at a high level only when opacity data is required. The particular brightness level required to determine document opacity is dependent upon the type of document being counted or batched and it is therefore desirable to allow the user to specify the brightness level used. The LED control circuit 306 further provides the CPU 302 with the capability to switch the LEDs to the document detection brightness level when the apparatus is in a stopped condition.

A keyboard interface circuit 308 is connected to the CPU 302 and to the keyboard 14 for allowing a user to specify or modify operating parameters during execution of the control program. A display interface 310 is connected to the CPU 302 for driving the display 16 which provides count and status information to the user. An RS-232 interface driver 314 is also connected to the CPU 302 so that the counting and batching apparatus can interface with an external device 316. The external device 316 may be a general purpose computer that is programmed to communicate with the apparatus and control the apparatus according to a serial communication protocol. The external device 316 may alternatively be a printer, such as a thermal printer, for printing piece counts, denomination counts, and grand totals of dollar amounts of documents counted by the apparatus. The CPU 302 is programmed to discriminate between different types of external devices according to connectors or jumpers which are set on the serial interface of the external device. External I/O via the RS-232 interface 314 may be employed either to complement or to replace direct entry of user commands via the keyboard 14.

A motor control circuit 312 is connected to the CPU 302 and is used to provide programmed control of the motor 321. The motor control circuit may turn the motor on and off, or vary the speed of the motor, in response to signals from the CPU 302.

Figure 6B:
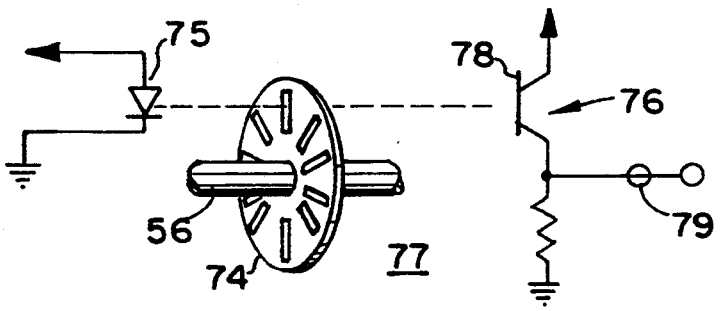
FIG. 6B is a schematic diagram of an electromechanical timing wheel for providing timing signals to the control system of FIG 6A.

The CPU 302 includes an interrupt input INT which is connected via interrupt line 79 to a timing wheel assembly 77. The timing wheel assembly which is shown schematically in FIG. 6B provides timing signals to the CPU 302 for use in coordinating the counting and sensor data accumulation functions during the transport of documents through the counting and batching apparatus. The timing wheel 74 is mounted upon the accelerator shaft 56 so that the rotation of the timing wheel 74 is synchronized to the rotation of the acceleration roller 52.

The LED 75 and photosensor 78 are positioned on opposite sides of the timing wheel 74 as previously described and are aligned so that as the wheel 74 rotates, a sensor bias circuit 76 produces a pulse coincident with the passage of each radial slot between the LED 75 and the sensor 78. The output of the sensor bias circuit 76 is transmitted by the interrupt line 79 to an interrupt port of the CPU 302. Preferably, the number of radial slots in timing wheel 74 is such that approximately 66 interrupt pulses are generated as a document passes between the acceleration roller 52 and 54. In terms of distance, an interrupt pulse is generated by the timing wheel assembly for approximately each millimeter of circumferential revolution of the acceleration roller 52.

Figure 7A:
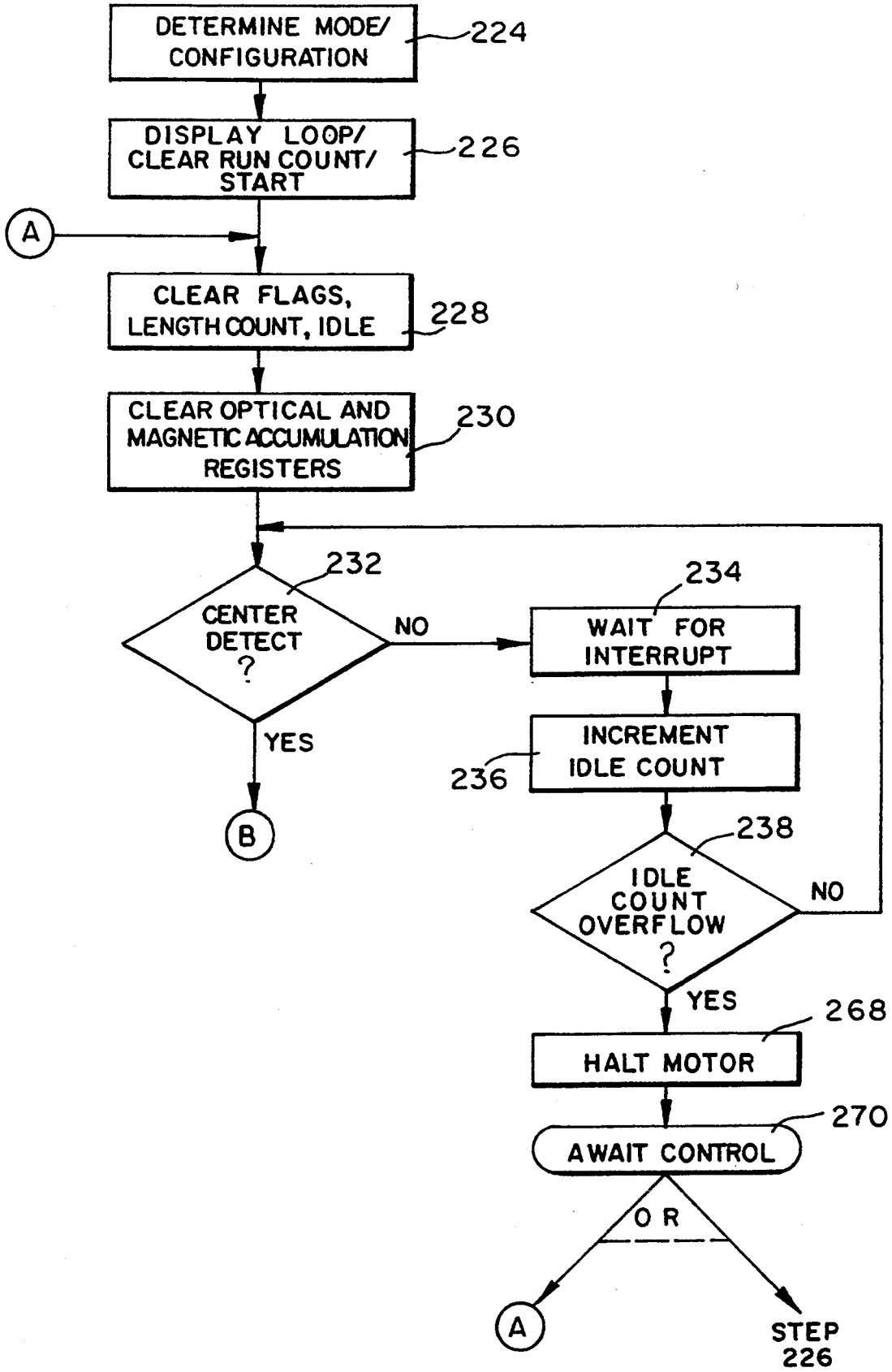
FIGS. 7A–7D are successive parts of a logical flow diagram of the control procedure executed by the control system of FIG. 6A.

A preferred control routine for controlling operation of the apparatus is shown in FIGS. 7A–7D as a flow diagram. The control routine encompasses the functions of command I/O, sensor data accumulation, sensor data evaluation, and document counting. Referring to FIG. 7A, initial step 224 is executed to determine the operational mode and configuration of the apparatus. During step 224, the CPU determines whether an external device is connected via the RS-232 interface. If an external device is detected, the RS-232 lines are tested for the presence of jumpers indicating whether the external device is a computer with which the CPU 302 will interact or whether the external device is a printer to which the CPU 302 will send output only. It is noted that references within this specification to user input via the keyboard and output via the display are also applicable to input from the external device and output to the external device, if it was determined in step 224 that such an external device is detected as connected in the system.

In step 226 pertinent initialization selections, such as the denomination of documents to be counted, batch or counting mode selection, batch size, operating speed, and verification options are input to the control procedure. The user may also cycle through a display loop in step 226 to obtain displays of accumulated piece counts, denomination counts and/or totals. The accumulated counts and/or totals may optionally be printed on the printer or uploaded to the host if the apparatus is connected to such external devices via the RS-232 port. Requesting the display of the accumulated counts and/or totals causes the counts/and or totals to be updated according to a run count. The run count is a register in which is stored the number of documents counted since the most recent display request. The run count is reset subsequent to each total display request. Whenever the grand total value count is requested, the CPU 302 calculates the grand total value from the individual denomination counts which may be stored in RAM 319 or in internal CPU registers.

Also in step 226, several threshold values used for error detection may be selected either by user input or from data previously stored in ROM. The document opacity level may also be selected by the user during step 226. The selected opacity level determines the brightness level at which the left and right LEDs 83 and 85 are lit during opacity testing. Magnetic detection of counterfeit suspect documents and/or opacity evaluation may be enabled or disabled by the user in step 226. If counterfeit suspect detection (CFS) is chosen, the threshold value against which magnetic data will be compared is selected by the CPU according to the specified operating speed. Such selection is necessitated by the dependence of the magnitude of the electrical signal produced by the magnetic read head 86 upon the speed at which documents pass by or adjacent the read head 86. In the preferred embodiment, the user can select between a high operating speed, on the order of 1200 documents per minute, and a low operating speed, on the order of 600 documents per minute. The low speed option is provided so that the user may visually determine the presence of counterfeit suspect documents by watching the documents as they are counted. Such visual counterfeit suspect determination may complement or replace magnetic counterfeit suspect determination. It has been found that a document counting speed on the order of 600 documents per minute is sufficiently slow to enable visual verification of documents.

Figure 8:
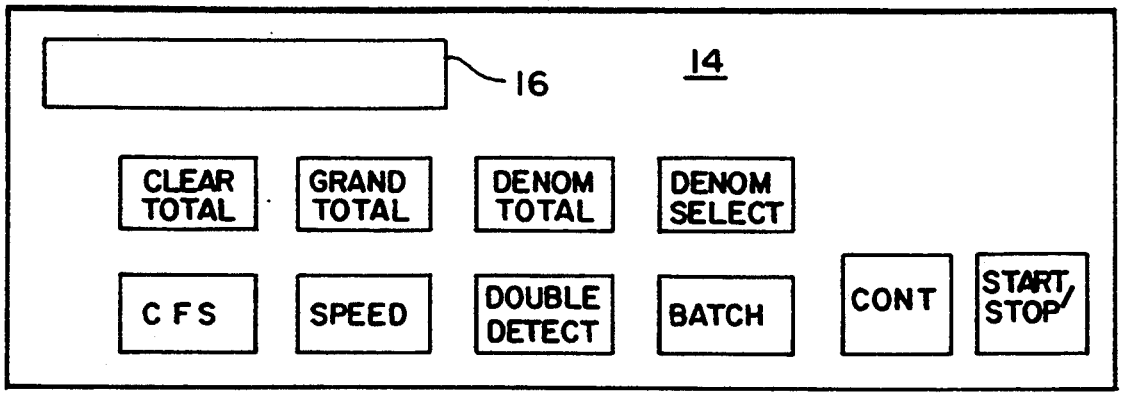
FIG. 8 is a plan view of the control panel of the apparatus of FIG. 1.

Initialization selections may be downloaded via the RS-232 interface or manually entered via the keyboard 14 which is shown in greater detail in FIG. 8. The keyboard 14 includes several switches by which the user may enter commands and select options as described in connection with step 226 of the control procedure. The keyboard 14 includes keys labeled START/STOP, CONT, BATCH, DENOM SELECT, DENOM TOTAL, GRAND TOTAL, CLEAR TOTAL, SPEED, CFS, and DOUBLE DETECT. The START/STOP key is a momentary switch which is pressed to start and stop operation of the apparatus. The CONT key is a momentary switch used to restart the counting and batching apparatus after the operation has been interrupted. Operation of the CONT key provides a signal to the counting and batching apparatus to restart operation and to continue the present count subsequent to detection and removal of a counterfeit suspect document or subsequent to operation of the START/STOP key. The DENOM SELECT key is used during step 226 of the control procedure to cycle through a list or menu to select that the denomination of bills to be counted in a particular run or to specify a piece count without regard to denomination. The DENOM TOTAL key is used to display accumulated totals of each denomination counted or the total piece count. The GRAND TOTAL key is pressed to display the sum of the accumulated dollar amounts of the individual denominations. The CLEAR TOTAL key resets the displayed accumulated total to zero. If CLEAR TOTAL is operated during display of the GRAND TOTAL, then all denomination totals are reset.

The CFS key is used during step 226 to toggle magnetic counterfeit suspect detection "on" or "off". The DOUBLE DETECT key is used during step 226 to select the LED brightness level for capacity testing or to disable opacity testing. The SPEED key is used during step 226 to select between the high operating speed and the low operating speed. The BATCH key is used during step 226 to select batch operation and the batch size. When selection of the initialization parameters in step 226 is completed, the motor is started and the control procedure then passes to step 228 upon depression of the START key.

In step 228, several variables pertaining to document testing are set to zero. As each document passes through the apparatus, the length of the document is measured by the count of timing pulses that occur while the center sensor 80 detects the presence of each document. The counting and batching apparatus is stopped if an unusually large number of timing pulses are counted while the center sensor is covered indicating the presence of a document. These two counts—the length count and the idle count—are reset in step 228 between the passage of each document. Two flags which are used to test for off-width documents—a right sensor flag and a left sensor flag—are also reset in step 228.

Proceeding from step 228 to step 230, several registers of RAM 319, which are used to accumulate document testing data, are reset. During the passage of each document, running totals of the left and right sensor signals, the magnetic signal conditioning circuit output, and the number of detected interrupt pulses are accumulated in respective registers of RAM 319. The totals stored in those registers are reset in step 230 between the passage of each document.

Proceeding from step 230 to step 232, the presence of a document is detected according to the value of the A/D channel corresponding to the center sensor 80. If the center sensor signal value is below a predetermined detection threshold, the control procedure branches to step 234 and waits for an interrupt pulse from the timing wheel. When an interrupt pulse is received in step 234, the control procedure continues to step 236 wherein the idle count is incremented. Then, in step 238, the idle count is compared to a predetermined limit. If, in step 238, the idle count does not exceed the limit, then the control procedure returns to step 232. If, in step 238, the idle count does exceed the idle limit, then control passes to step 268 wherein the apparatus is halted and then to step 270 wherein the control procedure awaits further input. From step 270, the control procedure may branch to step 226 upon receiving further initialization commands or the procedure may branch to step 226 upon detection of documents placed into the hopper. In general, the control path taken from step 270 is dependent upon the status condition which led to step 270 and the nature of the action taken by the user or the input from an external device.

Figure 7B:
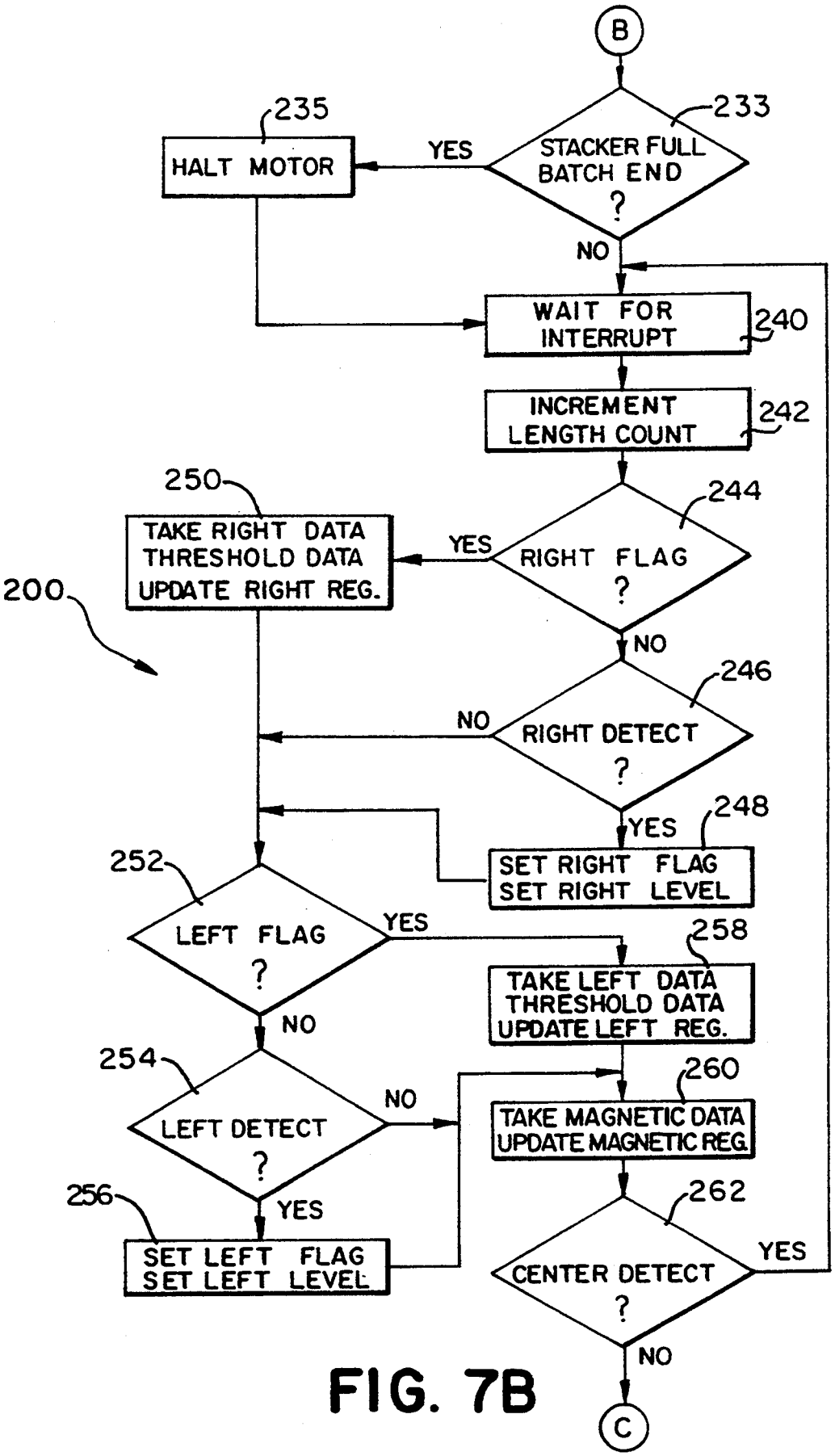
Figure 7C:
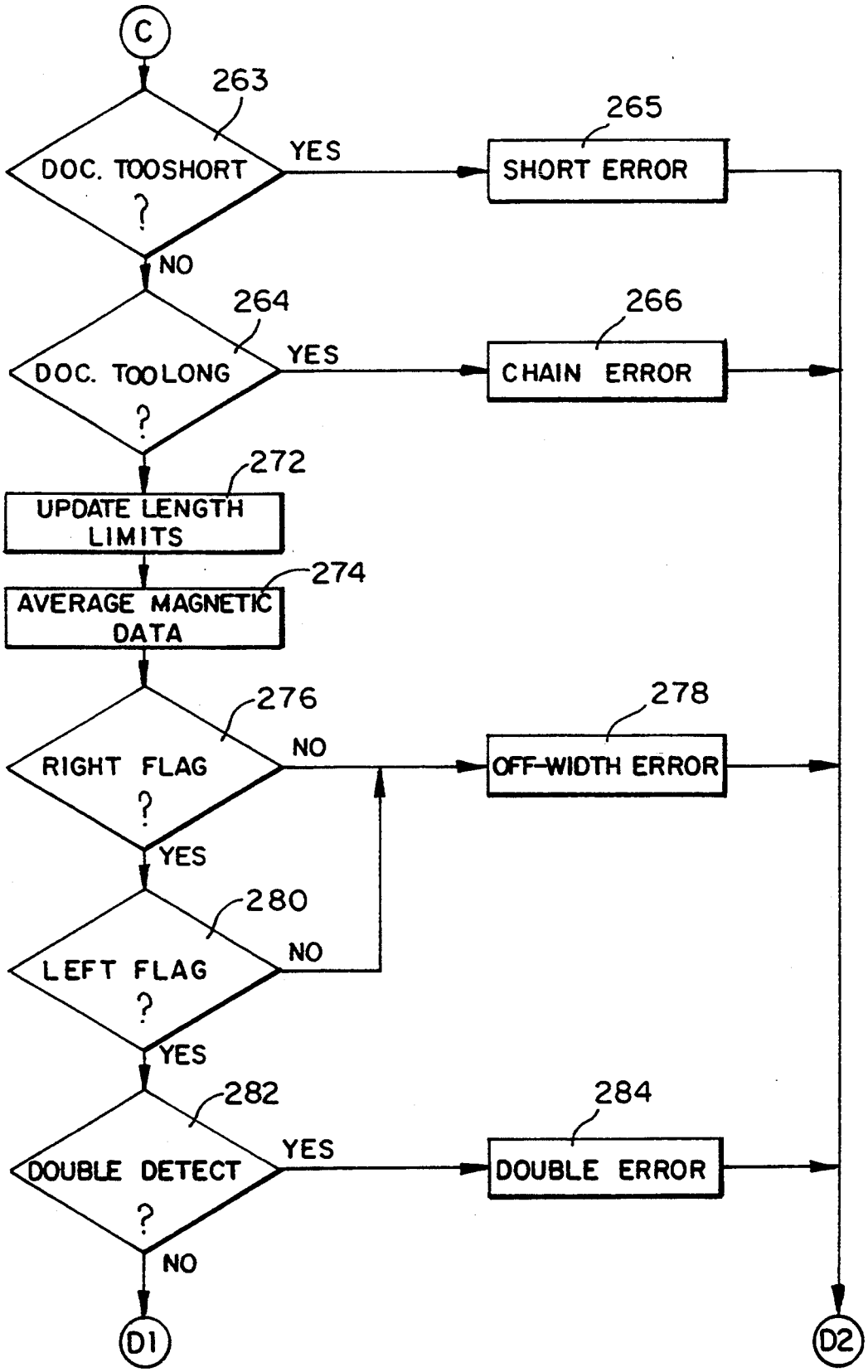
Figure 7D:
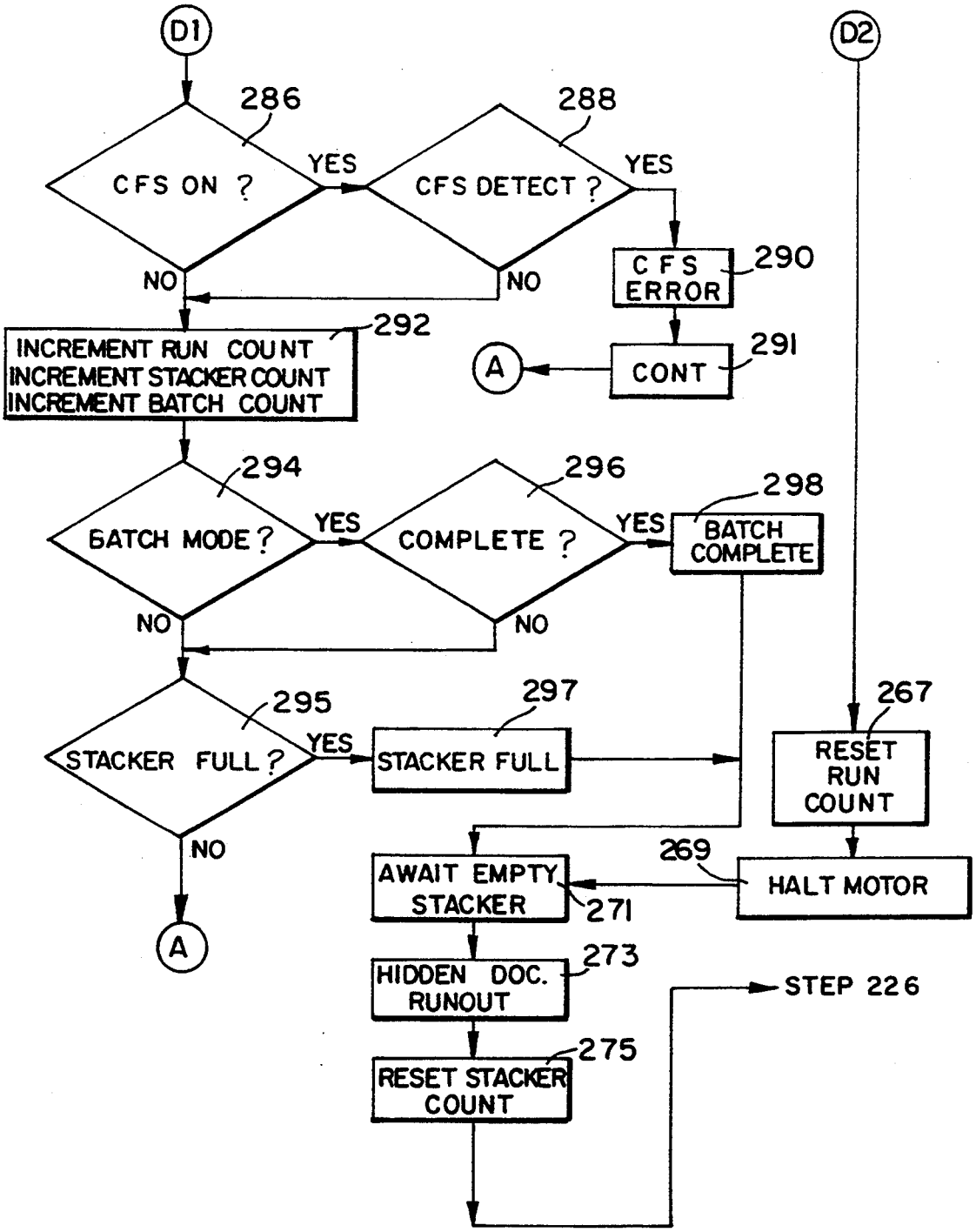

If, in step 232, the center document sensor does register the presence of a document, then the control procedure passes to step 233 of FIG. 7B as indicated by the continuation label B. In step 233, two conditions are tested to determine whether the motor should be halted. The first condition is whether the stacker count is has reached a value indicative of a full stacker less one document. Due to the high operating speed of the apparatus, the document transport mechanism cannot be instantaneously stopped. Consequently, if the stacker is about to become full, such a determination must be made when the leading edge of each document is detected. Likewise, if the apparatus is running in batch mode, a determination is made in step 233 whether the document presently detected by the center sensor would be the final document of a batch. If either of these two conditions are met, the control procedure passes to step 235 in which the motor control circuit begins to shut the motor down using a well-known dynamic braking technique. When the motor control circuit has begun to brake the motor or if neither condition was satisfied in step 233, then the control procedure passes to step 240.

Step 240 is the first step of a data accumulation loop 200 during which running totals of sensor data are generated as each document passes through the apparatus.

When an interrupt pulse is detected in step 240, the control procedure passes to step 242 wherein the document length count is incremented. From step 242, the control procedure passes to step 244. At step 244 a flag is checked which is indicative of the right sensor having previously detected a document. During the first iteration of the data accumulation loop 200, the right flag will not have been set and control will pass to step 246.

In step 246, the A/D channel corresponding to the right sensor will be polled to sample the right sensor signal in order to determine the presence of a document along the right side of the lower guide plate 50. If a document is detected, the control procedure proceeds to step 248 wherein the right sensor flag is set and the brightness of the right LED is set by the LED control circuit 306 according to the opacity level selected in step 226 and the control procedure proceeds to step 252. If, in step 246, a document is not detected along the right side of the lower guide plate 50, then the control procedure proceeds directly to step 252 and the right LED remains at the document detection brightness level. Off-width document detection occurs when either the left sensor flag or right sensor flag is not set during the document data accumulation loop 200. Once the right sensor flag is set in step 248, then subsequent execution of step 244 will cause the control procedure to branch to step 250. In step 250, the A/D channel corresponding to the right sensor is sampled and accumulated in a register of RAM 319 and the control procedure passes to step 252. The opacity data which is taken A/D converter from the right sensor in step 250 typically exhibits considerable small-scale variation. In order to clearly delineate between a normal document and a more opaque document, such as a double document, the opacity data is preferably coarsely quantized into a few broad ranges which are numerically weighted so that the effect of small-scale opacity variation is reduced. Discrimination between single and double documents can be adequately accomplished using only four levels of opacity data quantization.

Beginning at step 252, a similar decision sequence is conducted for the left document sensor as was conducted for the right sensor in steps 244–250. If the left flag is found to be set in step 252, then the control procedure passes to step 258 wherein the left sensor level is measured, quantized, and accumulated. The control procedure passes from step 258 to step 260. If, in step 252, the left flag is not found to be set, then the control procedure proceeds to step 254. In step 254, the left sensor is sampled and compared to a threshold to determine if a document is present at the left side of the guide plate. If a document is detected in step 254, then the control procedure proceeds to step 256 wherein the left flag is set. Also in step 256, the CPU 302 issues a signal to the LED control circuit 306 to increase the brightness of the left LED 83 to the opacity detection level selected in step 226. From step 256, the control procedure passes to step 260. If, in step 254, a document was not detected at the left photosensor, then the control procedure passes directly to step 260.

In step 260, the A/D channel corresponding to the output of the magnetic signal conditioning circuit 110 is sampled and accumulated. A control procedure then passes to step 262 wherein the A/D channel of the center sensor is again sampled to determine the presence of a document. If a document is still detected by the center detector, then the control procedure returns to step 240 to continue the data accumulation loop 200. When, in step 262, a document is no longer detected, then the data accumulation loop 200 is finished, and the control procedure branches to step 263 to begin a data evaluation phase of the control procedure shown in FIG. 7C as indicated by the continuation label C.

Beginning at step 263, the first of a series of tests is performed on the data accumulated during the data accumulation phase. It is noted that data evaluation tests can be made in other logical sequences than that shown in FIG. 7B. In step 263, the length count reached during the data accumulation loop 200 is compared to a length threshold value. If the length count is less than the length threshold, then the control procedure proceeds to step 265 in which the user is notified via the display 16 of a "half" error. From step 265, the control procedure passes as indicated by the continuation label D2 to step 267 shown in FIG. 7D wherein the run count is reset, and then it proceeds to step 269, wherein the motor is halted. Then, in step 271, the control procedure awaits a signal from the stacker photosensor that the documents have been removed from the stacker. If, in step 263 of FIG. 7C, the length count exceeds the lower threshold value, then the control procedure proceeds to step 264.

At step 264, the length count taken during the data accumulation loop 200 is compared to a length upper limit value. If the length upper limit value is exceeded by the length count, then a message indicating a chain error is shown by the display and/or output to the RS-232 port in step 266. From step 266, the control procedure passes as indicated by continuation label D2 to step 267 shown in FIG. 7D wherein the run count is reset and then proceeds to step 269, wherein the motor is halted. Then, in step 271, the control procedure awaits a signal from the stacker photosensor that the documents have been removed from the stacker. If, in step 264 of FIG. 7C, the length upper limit is not exceeded, the control procedure proceeds to step 272, wherein the length threshold and upper limit are updated according to a predetermined adaptation factor. The upper and lower length limits are preferably adjusted between each document to bracket the length of the most recently measured document by a predetermined proportion. Such proportional adaptation of the lower and upper length limits allows the apparatus to continuously adapt to variations of motor speed and/or minor variations in document length.

After the document length limits are updated in step 272, the accumulated magnetic data is divided by the length count to produce an average magnetic test value in step 274. The evaluation routine then proceeds to step 276 wherein the right flag is checked. If the right flag was not set during the data accumulation loop 200, then the routine proceeds to step 278 wherein the user is informed, by an appropriate display, of an off-width document error. From step 278, the control procedure passes as indicated by continuation label D2 passes to step 267 of FIG. 7D, wherein the run count is reset and then to step 269 wherein the motor is halted. Then, in step 271, the control procedure awaits a signal from the stacker photosensor that the documents have been removed from the stacker. If, in step 276 of FIG. 7C, the right flag is found to be set, then the routine proceeds to check the left flag in step 280 with similar results if the left flag is found not to be set. If the left flag is set, the control procedure proceeds to step 282.

In step 282, the contents of the left and right opacity data accumulation registers are compared to their respective threshold values determined in step 226. If the count on either of the opacity data accumulation registers exceeds the respective threshold value, then the user is informed of an error, such as a double error, in step 284. From step 284, the control procedure passes as indicated by continuation label D2 to step 267 of FIG. 7D wherein the run count is reset and then passes to step 269 wherein the motor is halted. Then, in step 271, the control procedure awaits a signal from the stacker photosensor that the documents have been removed from the stacker. If in step 282 of FIG. 7C, the counts related to the accumulated opacity data registers are below the respective thresholds or if double detection was disabled in step 226, then the control procedure proceeds to step 286 of FIG. 7D as indicated by continuation label D1.

In step 286, the evaluation routine determines whether counterfeit suspect testing (CFS) is enabled. If CFS detection is enabled, then the control procedure proceeds to step 288. In step 288, the average magnetic test value determined in step 274 is compared to a predetermined threshold value. If the average magnetic test value does not exceed the predetermined threshold, the user is provided with an indication of a counterfeit suspect error in step 290 and the motor is halted. Since the document transport mechanism cannot be instantaneously stopped, both the counterfeit suspect and the next document in the input stack, if any, are delivered to the stacker as the motor is halted in step 290. The control procedure then passes to step 291 in which normal operation is resumed by removal of the counterfeit suspect and the next document from the stacker, placing the next document back into the hopper, and pressing the CONT key. After the CONT key is pressed in step 291, the control procedure returns to step 228 of FIG. 7A as indicated by continuation label A and thus bypasses counting either the counterfeit suspect or the subsequent document delivered to the stacker plate.

If in step 286 it was found that CFS detection was disabled or if, in step 288, the CFS threshold was exceeded, then the control procedure proceeds to step 292.

In step 292, the run count and the stacker count are incremented. The stacker count is used to ensure that the capacity of the stacker is not exceeded. The stacker count is reset whenever the stacked documents are removed from the stacker. The run count is the piece count of documents counted since the last total display request made in step 226 of FIG. 7A.

Proceeding from step 292 to step 294, a branch is made to step 296 if the apparatus is set to run in batch mode. If, in step 296, the count of documents has reached the specified batch size, then the user is provided with an indication of a complete batch in step 298. Since the imminent completion of the batch had been detected in step 233, by the time that step 298 is reached, the motor has sufficiently slowed so that the present document is the final document delivered to the stacker plate. From step 298, the control procedure continues to step 271 and waits for removal of the batch from the stacker plate.

If, in step 294, the apparatus was determined not to be operating in batch mode or if, in step 296, batch completion was not detected, then the control procedure passes to step 295 wherein the stacker count is tested to determine whether the stacker plate is filled to its capacity. If the stacker plate is not determined in step 295 to be full, then the control procedure returns to step 228 in order to prepare to accumulate data for the next document. If the stacker plate is full, the control procedure passes to step 297 wherein an appropriate indication is made that the stacker is full. From step 297, the control procedure passes to step 271 and awaits removal of documents from the stacker.

Step 271 is reached whenever a batch is completed, the stacker is full, or an error other than a counterfeit suspect has been detected. During step 271, the user (or the controlling host) is informed of the status of the apparatus. In order to clear the error or to otherwise resume counting, the documents must be removed from the stacker. In contrast to the detection of counterfeit suspects, the detection of other errors also causes uncertainty in the count. For example, if step 271 has been reached as the result of a double error, the operator cannot be certain whether to remove two or three documents from the hopper in order to resume normal counting. The double error may have been generated by the simultaneous passage of two documents or by the passage of a single document of unusual opacity. In order to avoid corruption of the integrity of the accumulated counts and totals, detection of errors other than counterfeit suspect errors causes the run count to be reset and the operator must remove all of the documents from the stacker plate at step 271 and either return them to the hopper or terminate counting. Similarly, the other two conditions which may lead to step 271 —completion of a batch or a full stacker—require removal of all of the documents from the stacker plate. When the stacker photosensor indicates that the documents have been removed from the stacker plate, operation resumes and the control procedure passes to step 273.

Step 273 is a procedure to ensure that the document counter is not left in a "hidden document" condition. A hidden document is a document which may have been the last document in the hopper and was fed from the hopper but not delivered to the stacker during the motor halting operation which preceded step 271. Since such a document would not be visible to the operator, and there would be no other documents remaining in the hopper, a test is made in step 273 to determine whether the hopper is empty as determined by the hopper photosensor. If the hopper is empty, then the motor is restarted and allowed to run for one idle timeout interval so that any hidden document will be delivered to the stacker plate. Then, in step 275, the stacker plate count is reset since all documents have been removed from the stacker plate, and the control procedure returns to step 226.

Serial Communication Protocol

The apparatus is provided with a serial communication interface such as the RS-232 interface 314 for communicating with an external device 316 such as a printer or a computer. The CPU 302 is programmed to transmit and receive messages through the serial communication interface according to an ASCII code communication protocol. The external device begins each message with STX (ASCII 2) and terminates each message with ETX (ASCII 3). The external device may also send an ACK (ASCII 6) to acknowledge reception of messages from the apparatus or the external device may send a NAK (ASCII 21) to acknowledge non-reception of messages from the apparatus and request retransmission. The apparatus responds to messages from the external device by sending (i) an ACK if the message was properly received, (ii) a NAK if the message was undefined or otherwise in error, or (iii) a response message containing status or count information preceded by an STX and ending with an ETX.

Messages from the external device 316 to the CPU 302 supplant user entry of operating parameters as described in connection with step 226 of the control procedure. The operating parameters of the apparatus are set in step 226 by the external device 316 according to various command codes shown in Table II below.

TABLE II

| ASCII CODE | Command Codes<br>Command |
|---|---|
| PH | Set high speed. |
| PL | Set low speed. |
| DH | Set high opacity threshold. |
| DM | Set medium opacity threshold. |
| DL | Set low opacity threshold. |
| DD | Disable opacity threshold. |
| HU | Start on documents detected in hopper. |
| HI | Start on receipt of start command. |
| Bnnnn | Set batch mode, batch nnnn documents. |
| FE | Enable counterfeit suspect detection. |
| FD | Disable counterfeit suspect detection. |
| R | Reset count, reset error condition, start. |
| C | Start run without resetting count. |
| Q | Stop. |

The external device 316 requests or clears counting information and selects denominations to be counted according to the codes shown in Table III below. In response to a request code shown in Table III, the counting and batching apparatus sends the requested total as an ASCII numeric string preceded by STX and terminated in ETX. In response to a clear code, the apparatus sends an ACK and selects accumulation of the corresponding denomination.

TABLE III

| ASCII CODE | Count Request/Clear Codes<br>Request |
|---|---|
| T01 | Total $1, set $1 denomination count. |
| T02 | Total $2, set $2 denomination count. |
| T05 | Total $5, set $5 denomination count. |
| T10 | Total $10, set $10 denomination count. |
| T20 | Total $20, set $20 denomination count. |
| T50 | Total $50, set $50 denomination count. |
| THU | Total $100, set $100 denomination count. |
| TGT | Send sum of all denomination counts. |
| TCN | Send total piece count. |
| X01 | Clear $1, set $1 denomination count. |
| X02 | Clear $2, set $2 denomination count. |
| X05 | Clear $5, set $5 denomination count. |
| X10 | Clear $10, set $10 denomination count. |
| X20 | Clear $20, set $20 denomination count. |
| X50 | Clear $50, set $50 denomination count. |
| XHU | Clear $100, set $100 denomination count. |
| XGT | Clear sum of all denomination counts. |
| XCN | Clear total piece count. |
| A | Send current piece count. |

The external device 316 can also request status messages from the apparatus by sending an "S" to the apparatus. The apparatus sends status messages to the external device 316 in reply to such a request. In addition to indicating errors, the status codes sent by the apparatus indicate the presence or absence of documents in the stacker so that the external device may prompt the operator to take appropriate action and monitor the progress of the operator. The apparatus status message codes are listed in Table IV.

TABLE IV

| ASCII CODE | Apparatus Status Message Codes<br>Status |
|---|---|
| X | Host has sent illegal message. |
| R | Mechanism moving. |
| BQ | No errors, ready to run, stacker empty. |
| BD | Double error, stacker empty. |
| BC | Chain error, stacker empty. |
| BH | Half error, stacker empty. |
| BW | Off-width error, stacker empty. |

TABLE IV-continued

| ASCII CODE | Apparatus Status Message Codes<br>Status |
|---|---|
| BS | Counterfeit suspect error, stacker empty. |
| DQ | No errors, doc.'s in stacker. |
| DD | Double error, doc.'s in stacker. |
| DC | Chain error, doc.'s in stacker. |
| DH | Half error, doc.'s in stacker. |
| DW | Off-width error, doc.'s in stacker. |
| DS | Counterfeit suspect, doc.'s in stacker. |
| DB | Batch complete, doc.'s in stacker. |
| DF | Stopped, 100 doc.'s in stacker. |

From the foregoing disclosure and the accompanying drawings, it can be seen that the present invention provides certain novel and useful features that will be apparent to those skilled in the pertinent art. In particular, there has been described an improved document counting and batching apparatus wherein optical and magnetic verification tests are conducted according to programmable digital thresholding of sensor signals and wherein reliability is enhanced by reducing the influence of electrical noise upon such sensor signals.

The terms and expressions which have been employed are used as terms of description and not of limitation and there is no intention in the use of such terms and expressions of excluding any equivalents of the features and elements shown and described, or portions thereof, but it is recognized that various modifications are possible within the scope and spirit of the invention as claimed.

What is claimed is:

1. An apparatus for counting documents, comprising:

a guide plate defining a document transport path, said transport path having righthand, central, and lefthand path portions;

a right sensor disposed adjacent the righthand portion of said transport path for generating a right sensor signal in response to the presence of a portion of a document in said righthand path portion;

a center sensor disposed adjacent the central portion of said transport path for generating a center sensor signal in response to the presence of a portion of a document in said central path portion;

a left sensor disposed adjacent the lefthand portion of said transport path for generating a left sensor signal in response to the presence of a portion of a document in said lefthand path portion;

sampling means for sampling said left sensor signal, said center sensor signal, and said right sensor signal to produce representative digital values based on the responses of the respective sensors; and a programmable controller means programmed to produce in response to said representative digital values, (i) a count of the documents passing through the apparatus, (ii) control signals for operating the apparatus, and (iii) status signals for monitoring the operation of the apparatus.

2. The apparatus of claim 1 wherein said programmable controller includes a non-volatile memory for storing reference values for comparison by said controller to said representative values.

3. The apparatus of claim 2 wherein the non-volatile memory is replaceable with another non-volatile memory having different reference values.

4. The apparatus of claim 1 wherein said sampling means comprises:

timing means for generating timing pulses, and digital conversion means for producing said representative values; and said programmable controller being programmed to sample said representative values in response to said timing pulses.

5. The apparatus of claim 4 wherein the right sensor is operated in response to the timing pulses and the right sensor signal is indicative of opacity along a righthand segment of the document and the left sensor signal is operated in response to the timing pulses and the left sensor signal is indicative of opacity along a lefthand segment of the document, the right and left sensor signals being supplied to the digital sampling means.

6. The apparatus of claim 5 in which the programmable controller means includes accumulating means for accumulating the representative values and comparison means for comparing the accumulated representative values with predetermined values indicative of an authentic document to determine whether the opacity of the document is acceptable.

7. The apparatus of claim 1 further comprising a serial communication port operatively connected to said programmable controller for communicating with an external device.

8. The apparatus of claim 7 wherein said serial communication port is an RS-232 port.

9. The apparatus of claim 8 wherein said external device comprises a computer.

10. The apparatus of claim 8 wherein said external device comprises a printer.

* * * * *